US009068436B2

(12) United States Patent
Theron et al.

(10) Patent No.: US 9,068,436 B2
(45) Date of Patent: Jun. 30, 2015

(54) METHOD AND SYSTEM FOR SAMPLING MULTI-PHASE FLUID AT A PRODUCTION WELLSITE

(75) Inventors: Bernard Theron, Aberdeen (GB); John Nighswander, Katy, TX (US); Robert Saunders, Pasadena, TX (US); Andrea Sbordone, Rio de Janeiro (BR); Paul Guieze, Fontenailles (FR); Gerald Smith, Thiverval (FR)

(73) Assignee: ONESUBSEA, LLC, Houston, TX (US)

( * ) Notice: Subject to any disclaimer, the term of this patent is extended or adjusted under 35 U.S.C. 154(b) by 577 days.

(21) Appl. No.: 13/194,932

(22) Filed: Jul. 30, 2011

(65) Prior Publication Data

US 2013/0025854 A1 Jan. 31, 2013

(51) Int. Cl.

| | |
|---|---|
| ***E21B 49/08*** | (2006.01) |
| ***E21B 27/00*** | (2006.01) |
| ***E21B 33/035*** | (2006.01) |
| ***E21B 41/04*** | (2006.01) |

(52) U.S. Cl.

CPC ..... *E21B 49/08* (2013.01); *E21B 27/00* (2013.01); *E21B 33/0355* (2013.01); *E21B 41/04* (2013.01); *E21B 49/083* (2013.01)

(58) Field of Classification Search

CPC ..... E21B 49/081
USPC ..... 166/264, 357
See application file for complete search history.

(56) References Cited

U.S. PATENT DOCUMENTS

| | | | | |
|---|---|---|---|---|
| 5,127,272 | A | 7/1992 | Dean et al. | |
| 5,303,775 | A | 4/1994 | Michaels et al. | |
| 5,361,206 | A | 11/1994 | Tabeling et al. | |
| 5,377,755 | A | 1/1995 | Michaels et al. | |
| 5,411,084 | A * | 5/1995 | Padden | 166/230 |
| 6,216,532 | B1 | 4/2001 | Stephenson et al. | |
| 6,435,279 | B1 | 8/2002 | Howe et al. | |
| 6,467,544 | B1 | 10/2002 | Brown et al. | |
| 6,659,177 | B2 | 12/2003 | Bolze et al. | |
| 6,719,048 | B1 | 4/2004 | Ramos et al. | |

(Continued)

FOREIGN PATENT DOCUMENTS

| | | | |
|---|---|---|---|
| WO | WO2010106499 | A1 | 9/2010 |
| WO | WO2010106500 | A1 | 9/2010 |

OTHER PUBLICATIONS

International Search Report for the equivalent PCT patent application No. PCT/US2012/048212 issued on Feb. 14, 2013.

(Continued)

*Primary Examiner* — Kenneth L Thompson
*Assistant Examiner* — Ronald Runyan
(74) *Attorney, Agent, or Firm* — Conley Rose, P.C.

(57) ABSTRACT

A system and method for sampling fluid from a production wellsite are provided. The system includes an interface operatively connectable to the port and a separation circuit operatively connectable to the interface for establishing fluid communication therebetween. The separation circuit includes a pumping unit and at least one sample chamber. The pumping unit includes pumping chambers having a cylinder with a piston therein defining a fluid cavity and a buffer cavity. The fluid cavities define a separation chamber for receiving the fluid and allowing separation of the fluid therein into phases. The buffer cavities have a buffer fluid selectively movable therebetween whereby the fluid flows through the separation circuit at a controlled rate. The sample chamber is for collecting at least one sample of the phases of the fluid.

28 Claims, 22 Drawing Sheets

(56) References Cited

U.S. PATENT DOCUMENTS

| | | | | |
|---|---|---|---|---|
| 7,062,958 | B2 | 6/2006 | Diakonov et al. | |
| 7,073,609 | B2 | 7/2006 | Tabanou et al. | |
| 7,158,887 | B2 | 1/2007 | Betancourt et al. | |
| 7,243,536 | B2 | 7/2007 | Bolze et al. | |
| 7,379,819 | B2 | 5/2008 | Betancourt et al. | |
| 7,434,694 | B1 | 10/2008 | Elvin | |
| 7,440,283 | B1 * | 10/2008 | Rafie | 361/709 |
| 7,464,755 | B2 | 12/2008 | Edwards | |
| 7,610,961 | B2 | 11/2009 | Manin et al. | |
| 7,913,554 | B2 | 3/2011 | Bittleston et al. | |
| 2005/0150287 | A1 * | 7/2005 | Carnegie et al. | 73/152.28 |
| 2007/0079962 | A1 * | 4/2007 | Zazovsky et al. | 166/264 |
| 2007/0236215 | A1 | 10/2007 | Innes | |
| 2008/0041593 | A1 | 2/2008 | Brown et al. | |
| 2008/0115469 | A1 | 5/2008 | Lane et al. | |
| 2008/0135239 | A1 | 6/2008 | Edwards | |
| 2009/0004495 | A1 | 1/2009 | Schneider | |
| 2009/0028836 | A1 | 1/2009 | von Kalle et al. | |
| 2009/0126996 | A1 | 5/2009 | Villareal et al. | |
| 2009/0288836 | A1 | 11/2009 | Goodall | |
| 2010/0058221 | A1 | 3/2010 | Okuma et al. | |
| 2010/0059221 | A1 | 3/2010 | Vannuffelen | |
| 2010/0089569 | A1 | 4/2010 | van Zuilekom et al. | |
| 2011/0005765 | A1 | 1/2011 | Cumming | |

OTHER PUBLICATIONS

Charlie Tyrrell et al, The Role of Subsea Sampling in Muti-phase Metering, The Americas Workshop, Feb. 3-5, 2008, pp. 1-8.

Charlie Tyrrell, Subsea MPFM—Implementation and Lessons Learned, The Americas Workshop, Feb. 3-5, 2008, pp. 1-13.

Charlie Tyrrell et al, Maintenance and Surveillance of Subsea Multi-phase Meters, The Americas Workshop, Feb. 3-5, 2008, pp. 1-5.

* cited by examiner 100
106
102
112
110
108
114
122
ROV
104
123
101
116
125
118
120

METHOD AND SYSTEM FOR SAMPLING MULTI-PHASE FLUID AT A PRODUCTION WELLSITE

BACKGROUND OF THE INVENTION

1. Field of the Invention

The present invention relates generally to techniques for performing wellsite operations. More specifically, the present invention relates to techniques for sampling fluid at a production wellsite.

2. Background of the Related Art

Oil rigs are positioned at wellsites for performing a variety of oilfield operations, such as drilling a wellbore, performing downhole testing and producing located hydrocarbons. Downhole drilling tools are advanced into the earth from a surface rig to form a wellbore. Drilling muds are often pumped into the wellbore as the drilling tool advances into the earth. The drilling muds may be used, for example, to remove cuttings, to cool a drill bit at the end of the drilling tool and/or to provide a protective lining along a wall of the wellbore. During or after drilling, a tubular may be cemented into place to line at least a portion of the wellbore. Once the wellbore is formed, production tools may be positioned about the wellbore to draw fluid to the surface.

During wellsite operations, it may be desirable to obtain downhole fluid samples to determine various parameters of the wellsite. Techniques for sampling are described, for example, in U.S. Patent Nos. 2008/0135239, 6,467,544, 6,659,177, and 7,243,536. In some cases, the fluid may be separated during sampling as described, for example, in U.S. Patent/Application Nos. 7,434,694, 20080115469 and 20100059221. In some other cases, fluid may be sampled in zproduction or subsea operations as described, for example, in U.S. Patent/Application Nos. 2010/0058221, 2011/0005765, 2009/028836, and 6,435,279, and in PCT Application Nos. WO2010/106499, and WO2010/106500.

Despite the development of techniques for sampling, there remains a need to provide advanced techniques for sampling wellsite fluid. It is desirable that such measurements maintain the quality of the sample as it is collected and retrieved. The invention contained herein is directed at achieving these advanced techniques.

SUMMARY OF THE INVENTION

In at least one aspect, the techniques herein relate to a system for sampling fluid from a production wellsite. The production wellsite has a tubular extending into a subsea unit for producing a fluid therefrom and a port at the wellsite for accessing the fluid. The system includes an interface operatively connectable to the port for establishing fluid communication therewith, and a separation circuit operatively connectable to the interface for establishing fluid communication with the interface and the port. The separation circuit includes a pumping unit comprising a plurality of pumping chambers and at last one sample chamber. Each of the pumping chambers has a cylinder with a piston therein defining a fluid cavity and a buffer cavity. Each of the fluid cavities defines a separation chamber for receiving the fluid and allowing separation of the fluid therein into phases. Each of the buffer cavities has a buffer fluid selectively movable therebetween whereby the fluid flows through the separation circuit at a controlled rate (e.g., flow rate and/or pressure). The sample chambers are for collecting at least one sample of the phases of the fluid.

The system may also have a fluid separator upstream or downstream of the pumping unit; at least one sensor for detecting one of density, flow rate, pressure, temperature, composition, phase and combinations thereof; a pump for selectively moving the buffer fluid between the buffer cavities; a flushing unit for flushing fluid through the separation circuit; a remote operated vehicle operatively connectable to the separation circuit; a surface unit operatively connectable to the separation circuit; a plurality of valves for selectively diverting fluid through the separation circuit; at least one fluid control component comprising one of at least one pressure transmitter, at least one temperature sensor, at least one orifice, at least one restrictor, at least one probe, at least one meter, at least one flow diverter, at least one valve, at least one pump, at least one fluid separator, at least one flowline, and combinations thereof; an electrical component for operating the separation circuit; a retrievable skid for housing the interface and the separation circuit; a sand filter; and/or a temperature controller for selectively controlling temperature of the fluid.

The pumping unit may utilize a pressure differential at the port for selectively moving the buffer fluid between the buffer cavities. Operatively connectable may be hydraulically connectable and/or electrically connectable. The plurality of phases may be at least two of water, gas, oil, and/or sand. The plurality of pumping chambers may be positioned at an angle to facilitate separation therein.

In another aspect, the techniques herein may relate to a method of sampling fluid from the production wellsite. The method may involve establishing fluid communication between an interface and the port; establishing fluid communication between a separation circuit and the interface (the separation circuit comprising at least one sample chamber and a pumping unit, the pumping unit comprising a plurality of pumping chambers, the plurality of pumping chambers each having a cylinder with a piston therein defining a fluid cavity and a buffer cavity); selectively flowing the fluid between the separation circuit, the interface and the port at a controlled rate (e.g., flow rate and/or pressure) by selectively manipulating the buffer fluid between the buffer cavities of the plurality of pumping chambers; receiving the fluid in the fluid cavity of at least one of the plurality of pumping chambers and allowing separation of the fluid into a plurality of phases therein; and collecting at least one sample of at least one of the plurality of phases of the fluid in the at least one sample chamber.

The buffer fluid may be selectively manipulated using a pressure differential across the port or selectively manipulated using a pump. The method may also involve electrically connecting the separation circuit to the interface and the port for selective activation thereof, deploying at least a portion of the separation circuit with a remote operated vehicle deployed from a surface unit, retrieving at least a portion of the separation circuit with a remote operated vehicle deployed from a surface unit, flushing at least a portion of the fluid from the separation circuit, performing at least one pressure test, passing the downhole fluid through a fluid separator.

BRIEF DESCRIPTION OF THE DRAWINGS

So that the above recited features and advantages of the present invention can be understood in detail, a more particular description of the invention, briefly summarized above, may be had by reference to the embodiments thereof that are illustrated in the appended drawings. It is to be noted, however, that the appended drawings illustrate only typical embodiments of this invention and are, therefore, not to be considered limiting of its scope, for the invention may admit to other equally effective embodiments. The figures are not necessarily to scale, and certain features and certain views of the figures may be shown exaggerated in scale or in schematic in the interest of clarity and conciseness.

DETAILED DESCRIPTION OF THE INVENTION

The description that follows includes exemplary apparatuses, methods, techniques, and/or instruction sequences that embody techniques of the inventive subject matter. However, it is understood that the described embodiments may be practiced without these specific details.

Sampling of multi-phase fluid from a production wellsite may be performed to determine parameters of the fluid as it is produced from the wellbore. Such sampling may involve phase enrichment, the separation of the fluid into phases (e.g., oil, water, gas, sand, etc.) and retrieval of sufficient volumes for a full range of testing (e.g., composition, density, etc.). The techniques used herein may be adaptable to a variety of conditions, such as various wellsite configurations (e.g., various ports), various fluid conditions (e.g., temperature, pressure, etc.), and/or the presence of debris. The techniques used herein may also be performed to maintain fluid conditions (e.g., temperature, pressure, etc.), to avoid phase composition changes of the fluid, to provide continuous fluid processing, to reinject unwanted fluids back to the wellsite, to retrieve samples by constant pressure vessel(s), etc.

Figure 1:
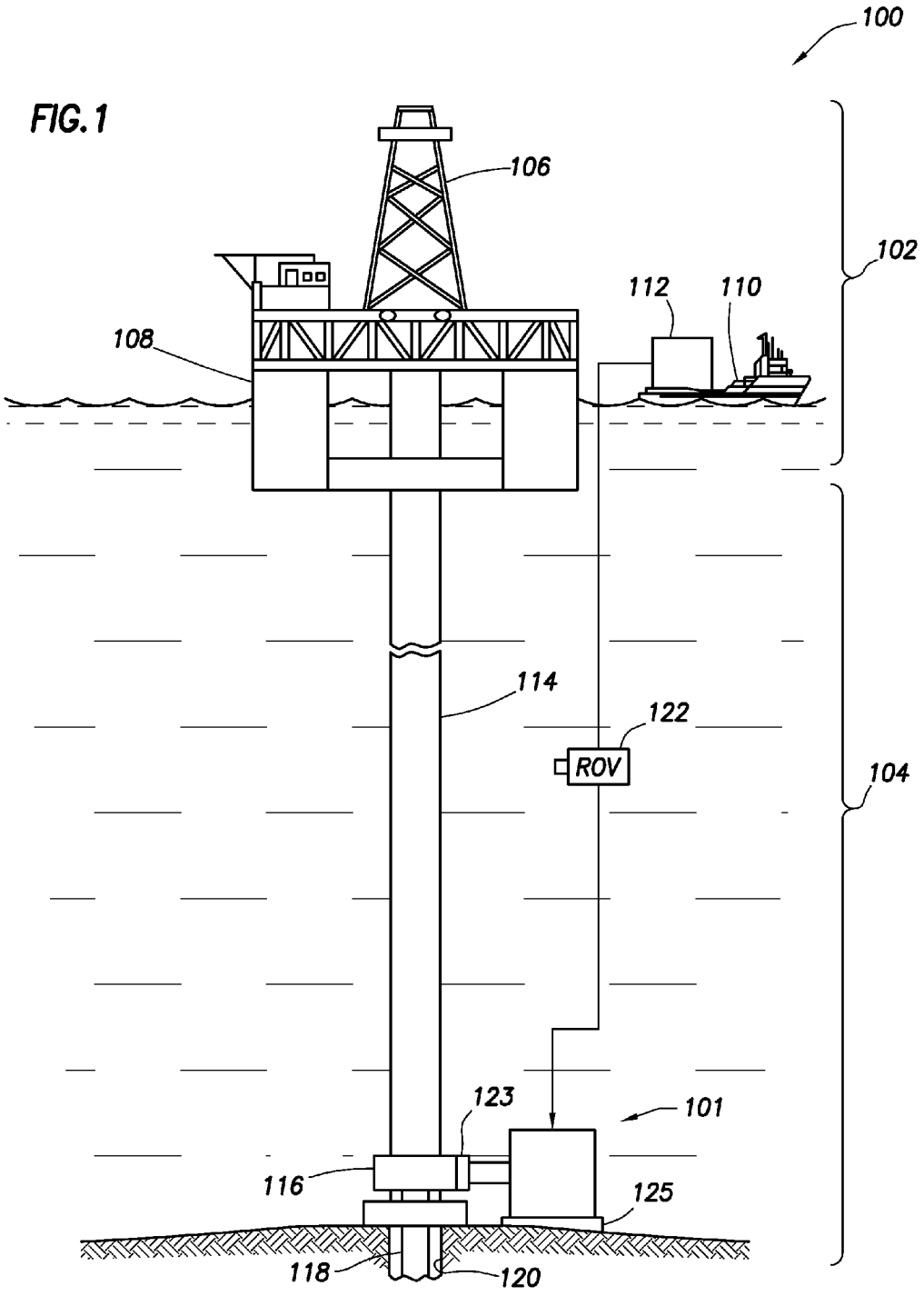
FIG. 1 is a schematic view of a production wellsite having a sampling system for sampling fluid.

FIG. 1 depicts an offshore wellsite 100 having a sampling system 101 in accordance with the invention. The wellsite 100 has a surface system 102 and a subsea system 104. The surface system 102 includes a rig 106, a platform 108, a vessel 110 and a surface controller 112. The surface controller 112 may be provided with hardware and software for operating the surface system 102 and subsea system 104.

The subsea system 104 includes a tubing (or conduit) 114 extending from the platform 108 to a subsea unit 116, a tubular 118 extending downhole from the subsea unit 116 into a wellbore 120, the sampling system 101, and a remote operated vehicle (ROV) 122 deployable from the vessel 110 to the sampling system 101. The subsea unit may include various subsea devices, such as a conveyance delivery system, manifold, jumper, etc. (not shown), may also be provided in the subsea system 104. While the wellsite 100 is depicted as a subsea operation, it will be appreciated that the wellsite 100 may be land or water based.

The sampling system 101 is connectable to a port 123 in the subsea unit 116 for sampling fluid flowing through tubular 118. The port 123 may be an inlet or fluid access to the fluid from the tubular 118. As shown, the subsea unit 116 is a wellhead, but may be any component of the wellsite that has fluids flowing therethrough, such as the manifold, jumper or other devices (not shown). The sampling system 101 is fluidly connectable to the port 123 of the subsea unit 116 for receiving fluid therefrom. Fluid may be passed between the subsea unit 116 and the sampling system 101 during sampling operations as described further herein.

The sampling system 101 may be deployed to the subsea location on a skid 125. The skid 125 may be self sufficient, or deployed and/or operated by the ROV 122. In some cases, the ROV 122 and the skid 125 may be a single unit deployable to the subsea location. The ROV 122 may be linked to the vessel 110 and controlled thereby. The ROV 122 may be linked to the sampling system 101 for communication therewith. The ROV 122 may be used to provide power and/or control signals to the sampling system 101, and/or to retrieve data and/or samples from the sampling system 101. Collected samples may be taken back to the surface for analysis by the ROV 122. While the ROV 122 may be used to provide communication, power, transportation of samples and/or other capabilities, such features may be provided by other devices and/or within the sampling system 101 and the like.

To operate the surface system 102, subsea system 104 and/or other devices associated with the wellsite 100, the surface unit 112 and/or other controllers may be positioned about the wellsite and placed in communication with various components of the surface system 102 and/or subsea system 104. These controllers may be linked and/or activated by any suitable communication means, such as hydraulic lines, pneumatic lines, wiring, fiber optics, telemetry, acoustics, wireless communication, etc. The surface system 102 and/or subsea systems 104 at the wellsite 100 may be automatically, manually and/or selectively operated via one or more controllers (e.g., surface unit 112). Some such controllers may be separate units at the surface, such as surface unit 112, or at other locations, such as incorporated as part of sampling system 101.

Figure 2:
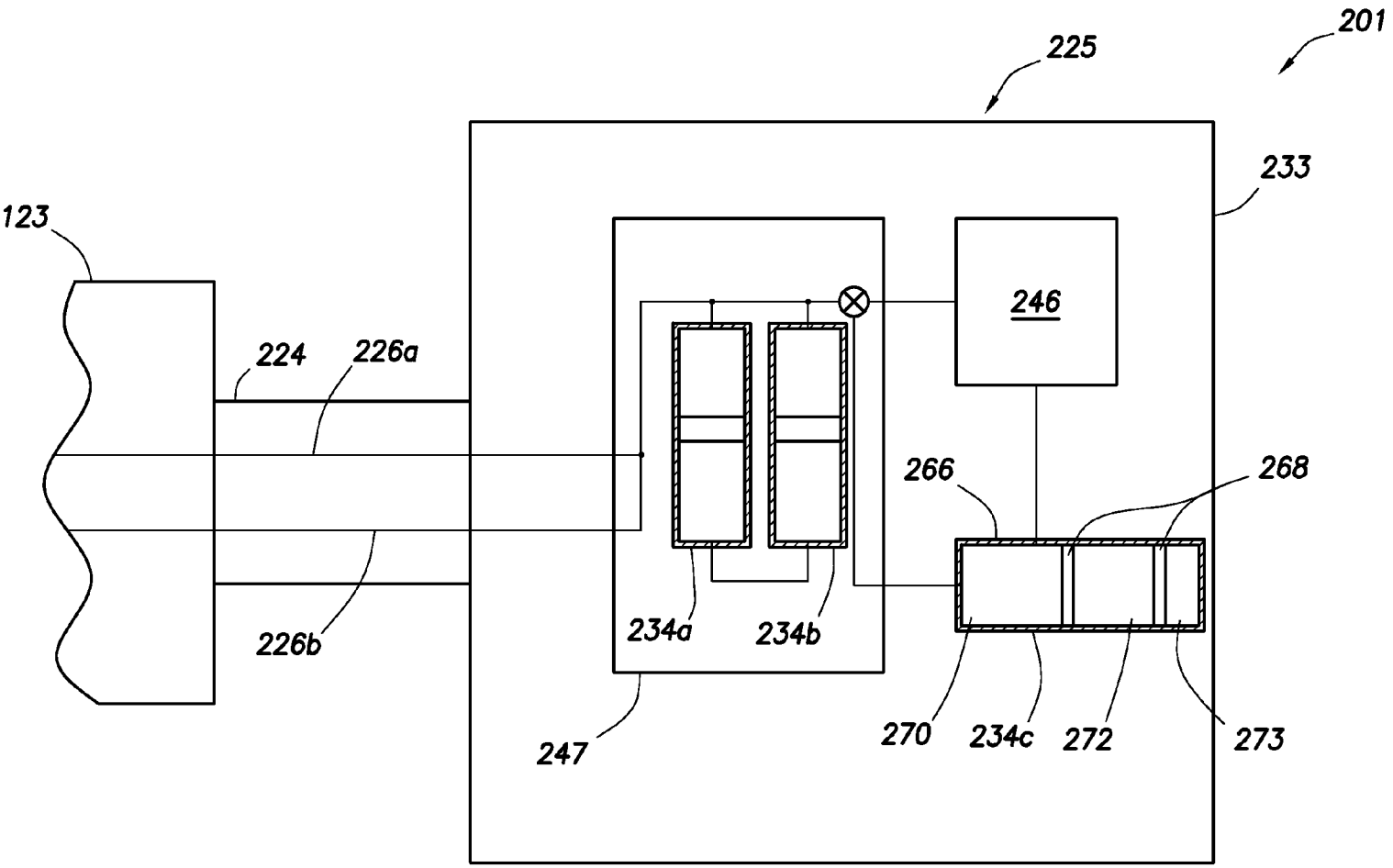
FIG. 2 is a schematic view of a sampling system having a separation circuit.

Referring to FIG. 2, a sampling system 201 usable as the sampling system 101 of FIG. 1 is depicted. The sampling system 201 includes an interface 224 operatively connectable to the port 123, and a separation circuit 225. The interface 224 may be used to fluidly connect the sampling system 201 to the port 123 for passing fluid therebetween. The sampling system 201 may have a separation circuit 225 for separating the fluid into phases, and a sample chamber 234 for collecting samples. The sampling system 201 may be provided with various valves, flowlines, or other flow devices to manipulate flow therethrough as will be described further herein.

The sampling system 201 may be operated at certain conditions to maintain quality parameters, such as pressure and temperature of the fluid, and/or to cope with fluctuating inlet rates. For example, the sampling system 201 may be manipulated to maintain multiphase mixtures of live hydrocarbon at or near saturation pressure. At saturation pressure, decreases in pressure may result in the liberation of gas within the fluid (which may be gas or water), or the condensation of liquid within the gas phase, which may cause a deviation of the fluid composition and/or an unrepresentative sample. Liberation of gas may also amplify the mixture velocity (similar to opening a bottle containing a carbonated drink) and further inhibit separation. Variations of pressure may be inherent to systems where fluid is received at high pressure and released at low pressure. The separation circuit 225 may be used to dampen variation of speed in the intake of fluid and facilitate fluid separation, thereby minimizing phase composition change.

The sampling system 201 may use a differential pressure ΔP at the port 123 to facilitate flow through the separation circuit 225. The differential pressure may be a pressure difference across the subsea unit 116 (e.g., across a production choke valve, a choked flow control or another area of delta pressure). This differential pressure may provide sufficient pressure between a high pressure side and a low pressure side of the subsea unit 116 to drive fluid flow. The high pressure side of the fluid flow stream may be used to bring the sampling fluid into the sampling system 201. The lower pressure side of the flow stream may be used to allow fluid discharge from the sampling system back into the wellbore via outtake flowline 226*b*. The flowlines 226*a,b*may be interchangeable to permit fluid to pass in either direction therethrough. The discharged fluid may be replaced with the same volume of sampled fluid. Thus, the differential pressure at the interface 224 may be used to draw fluid into the sampling system 201.

The sampling system 201 may be usable at a wellsite with or without a differential pressure at the port 123. A pumping unit 247 may be used to draw fluid through the interface 224 and into the sampling system 201. The pumping unit 247 may include one or more pumping chambers 234*a,b*. The pumping unit 247 may be used to manipulate fluid flow therethrough to control pressure, to control fluid temperature, and/or to separate the fluid as is passes through the sampling system 201. Fluid may be collected in the pumping unit 247 and stabilized to allow it to separate into phases within the pumping chambers 234*a,b*. Separated fluid may be collected in pumping chamber 234*a,b* or diverted to a sample chamber 234*c* inside or outside of the pumping unit 247.

One or more sample or pumping chambers 234*a-c* may be used in the separation circuit 225 to collect samples of separated fluid. The sample chambers 234*c* used herein may be conventional sample chambers used for collecting fluid samples. The sample chambers 234*c* may have a cylinder 266 with a piston 268 slidably positionable therein to define a sample cavity 270 for receiving the downhole fluid and a buffer cavity 272 having a buffer fluid therein. Optionally, the sample chambers 234*c* may have additional features, such as a charging chamber 273 with a second buffer fluid (e.g., Nitrogen). The sample chambers 234*c* may be provided with additional pistons, charging chambers, charging fluids and/or other features as desired. Pump chambers 234*a,b* may be the same as sample chambers 234*c*.

The pump 247 and/or separator 246 may be used to control the flow as it is passed through the separation circuit 225. In some cases, fluid flow may need adjustment, such as where differential pressures across the sampling system 201 is too high, where the fluid separator 246 may be flooded, when samples are taken at downstream conditions, and/or where sampling rate variations are induced by quick pressure variations (or flashes) received from the pump 247. To provide necessary adjustments, the pump 247 may be varied, the fluid separator 246 may be activated to absorb fluid variations, the pump 247 may be installed upstream of the fluid separator 246, and/or the pump may be operated in "braking" mode to adjust flow rates.

The separation circuit 225 may have additional functions and features. For example, a separator 246 may optionally be provided upstream or downstream of the pump to facilitate separation of the fluid into phases as it passes through the separation circuit 225. A temperature controller, such as the thermal barrier 233 may also be provided to control temperature (actively or passively) in the sampling system and/or of the fluid. The individual sample chambers 234 may also have temperature controllers to selectively maintain and/or reduce temperature. The temperature may be adjusted to achieve a desired temperature and/or to maintain certain properties (e.g., phases).

FIGS. 3A-3K each show a detailed, schematic view of a sampling system 301 usable as the sampling systems 101, 201 of FIGS. 1,2. These figures sequentially depict the sampling system 301 performing a sampling operation. The sampling system 301 is depicted as having a separation circuit (or module) 325 and an interface 324 operatively coupled to the port (or tree) 123. Fluid may be passed into the sampling system 301, separated into phases for sampling, and collected for retrieval.

The port 123 may have various devices for fluidly connecting the sampling unit 301 to fluid in the subsea unit 116 (see FIG. 1). The port 123 as shown has a flushing fluid 382, a tree control 384 and production fluid access flowlines 386*a,b* in fluid communication with the subsea unit 116, but may vary with the wellsite features. Interface 324 may have various devices for operatively interacting with the port 123 to facilitate flow of the fluid between the subsea unit 116 and the sampling system 301. The separation circuit 325 is fluidly, electrically and/or hydraulically connected to the port 123 via the interface 324. The interface 324 as shown has various flowlines 226*a,b* and valves 335*a-h* for fluid interaction with the port 123 and the separation circuit 325. The interface 324, port 123, and separation circuit 325 also have links 393 for electrical and/or hydraulic coupling therebetween (and with the ROV 122 and the surface unit 112 if present).

Intake flowline 226*a* and outtake flowline 226*b* of interface 324 are fluidly connected to the production fluid access flowlines 386*a,b* in port 123, and to circuit flowlines 326*a,b* in the separation circuit 325 for fluid communication therebetween. Connectors 388*a,b* fluidly connect the circuit flowlines 326*a,b* of the separation circuit 325 to the intake flowline 226*a* and outtake flowline 226*b*, and electrically and/or hydraulically connect the interface 324 with the separation circuit 325 for electrical and/or hydraulic interaction therebetween and with port 123. Valves 355*a,b* are connected to production flowlines 386*a,b* and valves 335*a-h* are positioned in intake/outtake flowlines 226*a,b* of the interface 324 for selectively diverting flow therethrough. A connector 388*b* electrically and/or hydraulically connects the interface 324 with the separation circuit 325 for electrical and/or hydraulic interaction therebetween, and with port 123.

Separation circuit 325 may include a pumping unit 347, a flushing unit 349, sample chambers 334(*a-g*) and valves 352 (*a-l*). Separation circuit 325 has sample chambers 334*a-d* fluidly connected to circuit flowline 326*a* and sample chambers 334*e-g*fluidly connected to circuit flowline- 326*b*. The sample chambers 334*a-g* may be the same as sample chamber 221 234 of FIG. 2, or may vary as desired. Sample chambers 334*a-d* may be used to collect samples of the downhole fluid drawn into the separation circuit 325.

Sample chamber 334*e* as depicted is the flushing unit 349 fluidly connected to flowline 326*b* for selectively flushing fluid from the separation circuit 325. The flushing unit 349 may include one or more sample chambers 334*e* fluidly connected about the separation circuit 325. The flushing unit 349 may also be fluidly connected to the sample chambers 334*a-d* by circuit flowline 374*e*1. Valves 352*g-j* may selectively permit passage of fluid between the sample chambers 334*a-d* and flushing unit 349. Flushing unit 349 may be used to flush fluid from the sample chambers 334*a-d* and the flowline.

Sample chambers 334*f,g* as depicted are pumping chambers 334*f,g* used as the pump 347 for selectively pumping fluid through the separation circuit 325. The pumping unit 347 includes two pumping chambers 343*f,g* for selectively manipulating fluid flow through the sampling unit 301, but one or more such chambers or other pumping devices may be used. The pumping chambers 343*f,g* are fluidly connected to circuit flowlines 326*a,b*. Sample chambers 334*f,g* have sample cavities 370*f,g* with sample flowlines 374*f*1-*g*1 fluidly connected to circuit flowline 326*a* for receiving or discharging fluid therefrom.

Buffer cavities 372*f,g* of pumping chambers 334*f,g* are fluidly connected together by a buffer flowline 376*g*. A pump 374 may be provided between the buffer cavities 372*f,g* for manipulating flow into the pump 347, for example, to draw fluid through the separation circuit 325 at a desired rate. Fluid may be drawn into the sample cavities 370*f,g* of the sample chambers 343*f,g* for separation therein. Separation may occur by gravitational separation in the sample cavities 370*f,b*. A sand filter 373 may also optionally be provided.

The fluid may then be selectively pumped out of the sample cavities 370*f,g*, through sample flowlines 374*f*2-*g*2 to the sample chambers 334*a-d*. Valves 352*b-e,k-o* may be used to selectively divert fluid to the sample chambers 334*a-d*. Sample chambers 334*a-d* may be in selective fluid communication with sample cavities 370*f-g* via flowlines 374*a*1-*d*1 for receiving fluid therefrom. Sensors 380 in sample flowlines 374*f*2,*g*2 may be provided to determine when to allow fluid to divert. Once the sensors 380 detect a given phase of a fluid, the fluid may be diverted into a sample cavity 370*a-d* of a desired sample chamber 334*a-d*. Sample chambers 334*a-d* may be used to collect and store separated fluid for retrieval to the surface. The separation circuit 325 may optionally be provided with a separator 246 for separating the fluid.

The separation circuit 325 may also be provided with electrical components 390*a,b,c* electrically coupled to the ROV 122 and the surface unit 112. Electrical component 390*a* is depicted as a communication unit, such as a transceiver, for communicating with the ROV 122 (or other communication devices). Electrical component 390*b* may be a power source, such as a power supply or battery, electrically coupled to a power source 392*a* in the ROV 122 and/or the surface unit 112. Electrical component 390*c* may be a computer unit, such as a controller, processor, and/or database, electrically linked to the surface unit computer 392*b* via ROV 122. The ROV 122 may also be provided with a hydraulic source 392*c* for powering the fluid devices, such as valves in the separation circuit 325, interface 324 and/or port 123. The links 393 may be used, for example, to power, activate and/or control components, such as valves of the sampling system 301 and/or port 123.

During operation, commands may be sent, for example, from the surface unit 112 and/or ROV 122 to the separation circuit 325, interface 324 and/or port 123 to activate various flow control devices, such as sample chambers 334*a-g*, pump 347, valves 352*a-o* or other devices therein. Each of the FIGS. 3A-3G sequentially depict steps of a sampling operation. In the initial step of FIG. 3A, the valves 352*a-j,m,o* are closed and valves 352*k,l,n* are open.

Figure 3A:
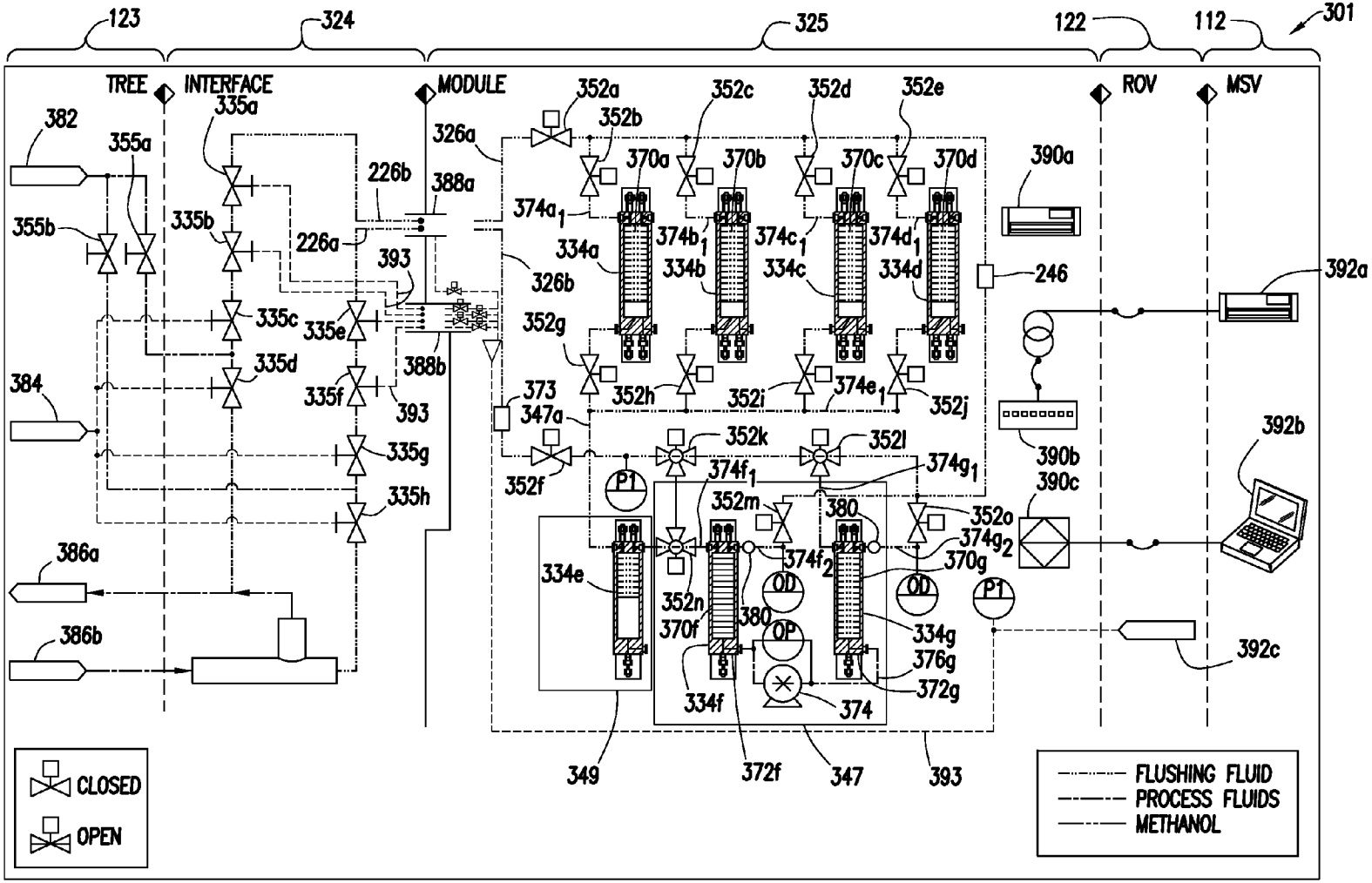
FIGS. 3A-3K are detailed, schematic views sequentially depicting operation of a sampling system having a separation circuit with a pumping unit.
Figure 3B:
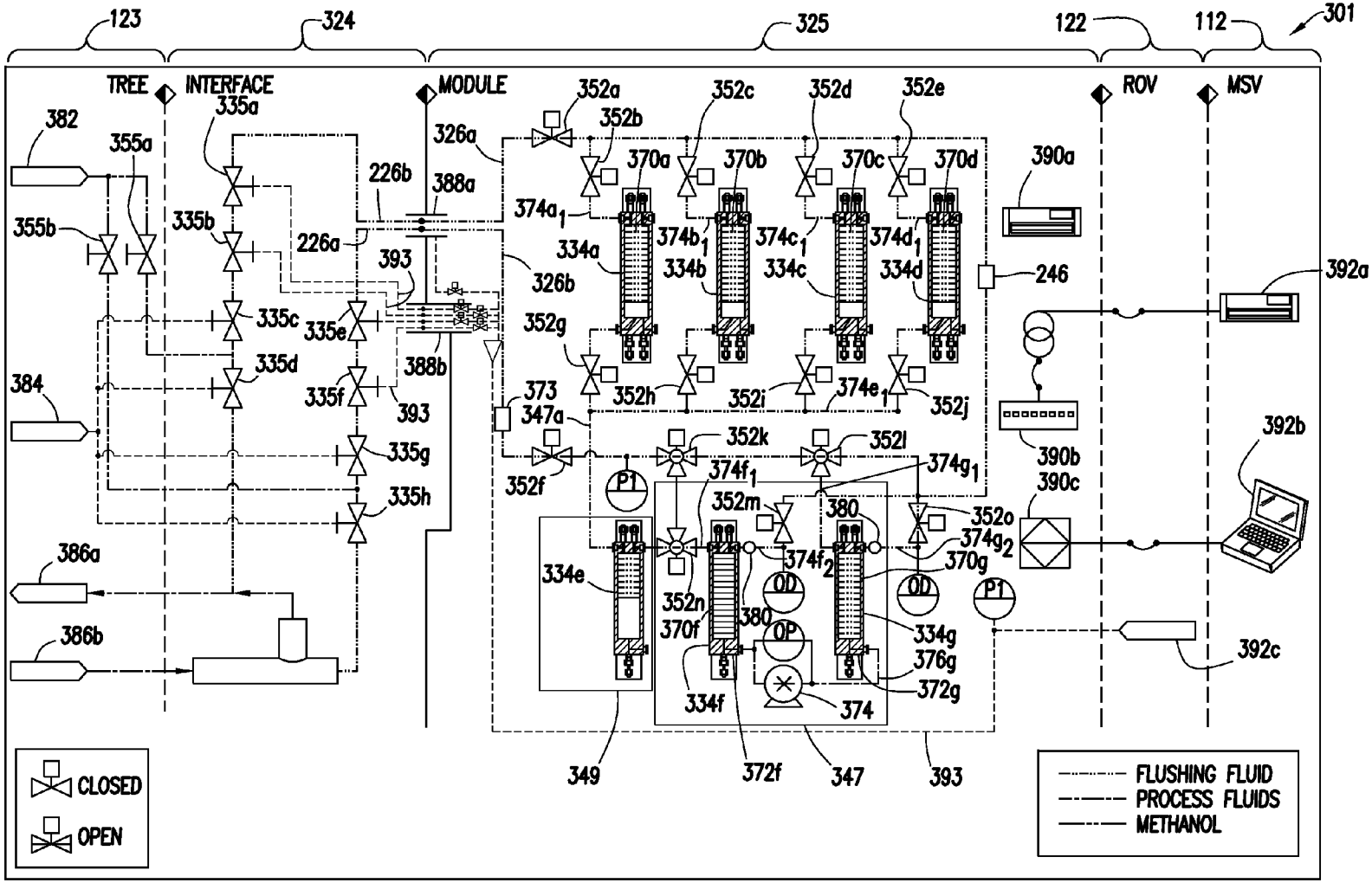

In the hot stab step of FIG. 3B, a connection is established between separation circuit 325 and interface 324 via connector 388*a,b* for hydraulic and/or electrical interaction between separation circuit 325 and interface 324. As also shown in FIG. 3B, valves 352*a,f,k,l,n,o* are opened for performing a pressure test. The pressure test may be used to verify that the hot stab connection between the port 123, interface 324 and/or sampling circuit 325 is working satisfactorily. The pressure test may be performed, for example, by using pumping unit 347 to draw fluid into the sampling circuit from flushing unit 349. Sensors 380 (and/or other sensors) may be used to monitor pressure and relay data to the ROV 122 and/or surface unit 112 as necessary.

Figure 3C:
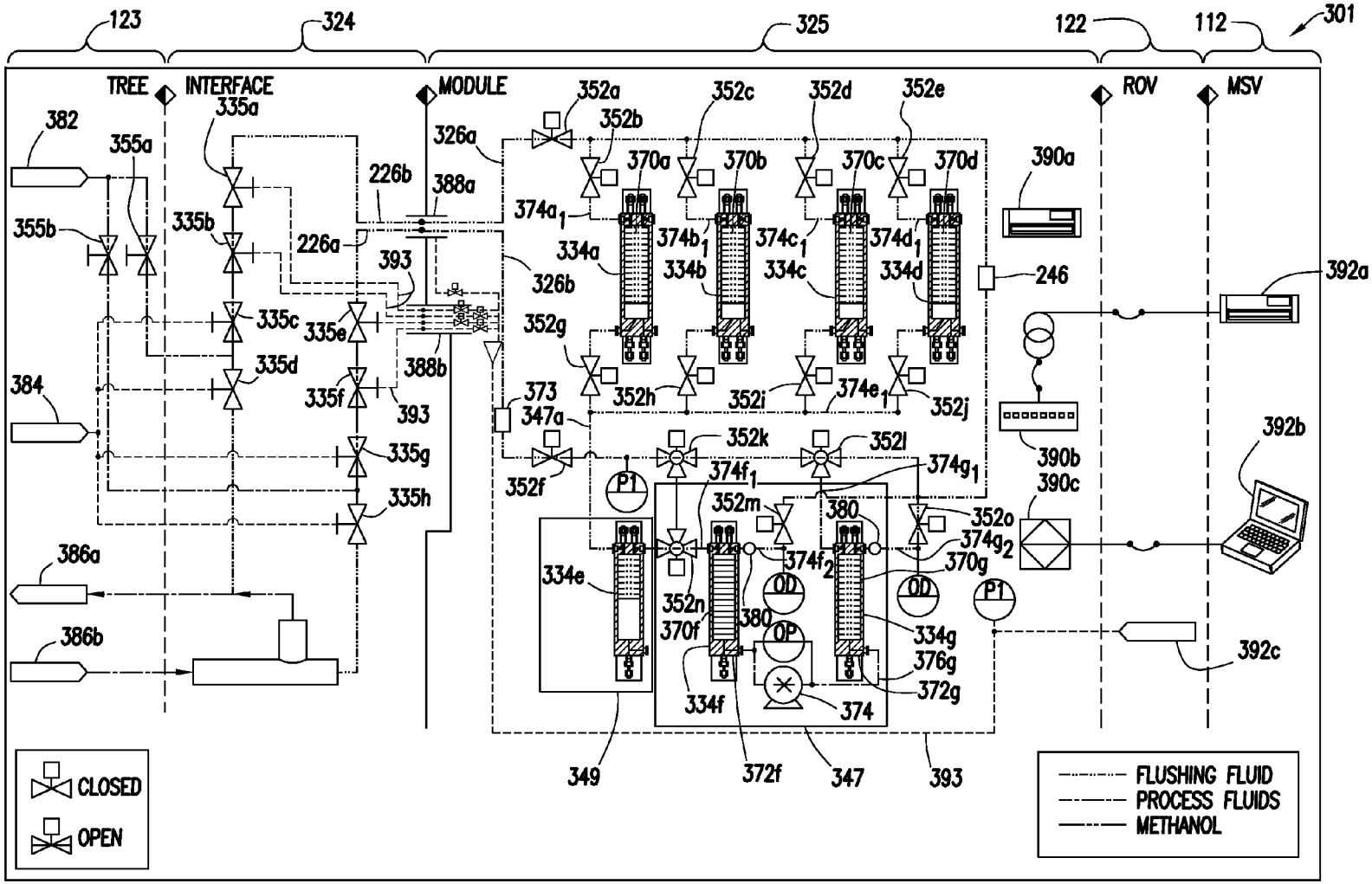

In step 3 of FIG. 3C, a pressure test may be performed by opening port valves 355*a,b* to the tree flushing fluid 382, and opening interface valves 335*b,c,f,g*. As shown in FIG. 3C (and after performing the hot stab test of FIG. 3B), the fluid of the pumping unit 347 and flushing unit 349 may be used to perform the pressure test on valves 335*a -b* of interface 324. In some cases, flushing fluid 382 may be used to perform the pressure test on valves 335*a-b*.

Figure 3D:
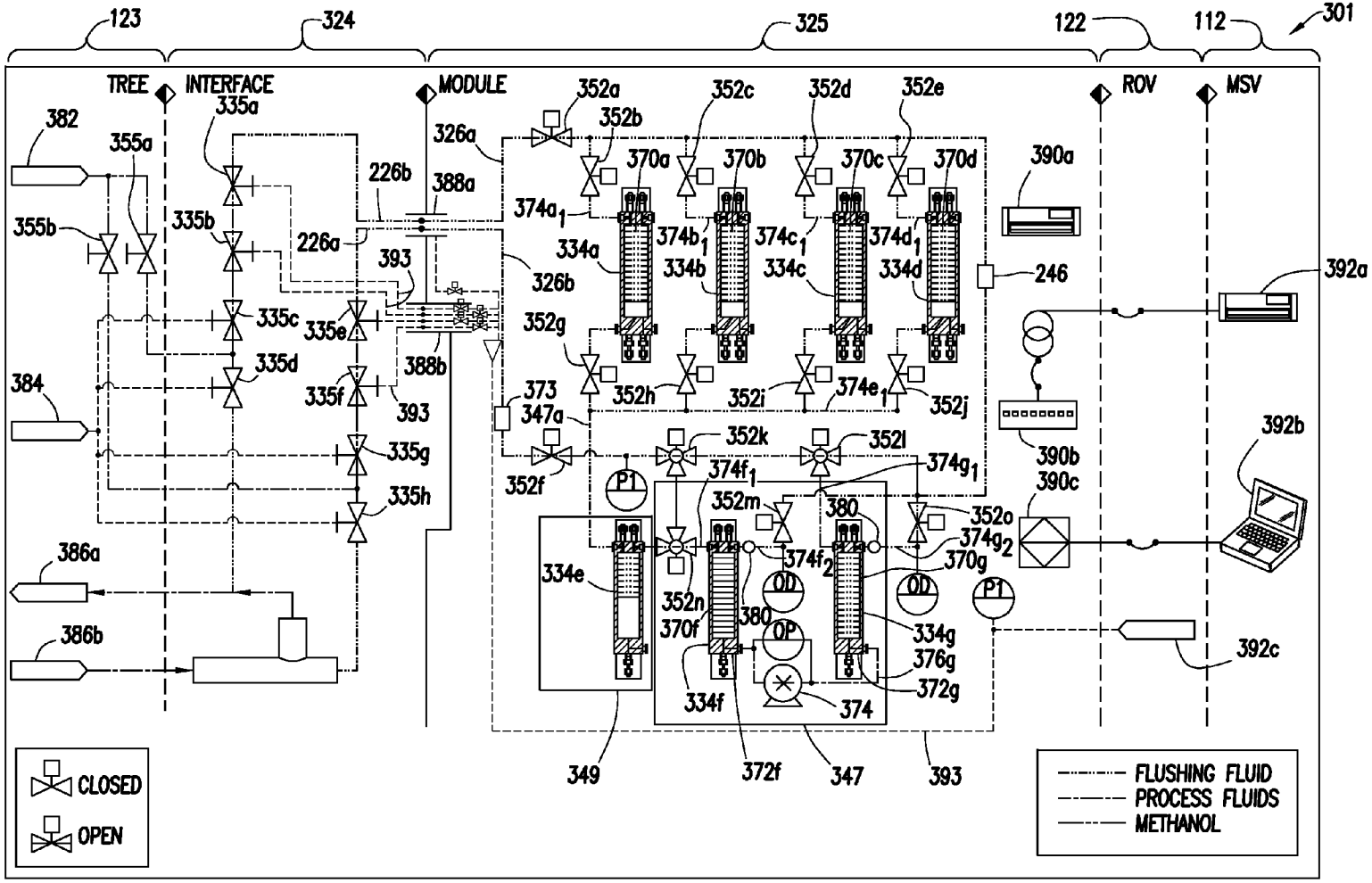

Interface valves, such as 335*a,b,e,f* and/or others, may be opened by link 392*c* as shown in FIG. 3D. The interface valves 335*a,e* may to fluidly link hydraulic unit 392*c* with the flushing fluid 382. Sensors may be provided about port 123 to measure pressure. Data gathered by these sensors may be captured by the computer unit 390*c* and passed to the ROV 122 and/or surface unit 112, for example, when a connection is provided in 388*b*.

Figure 3E:
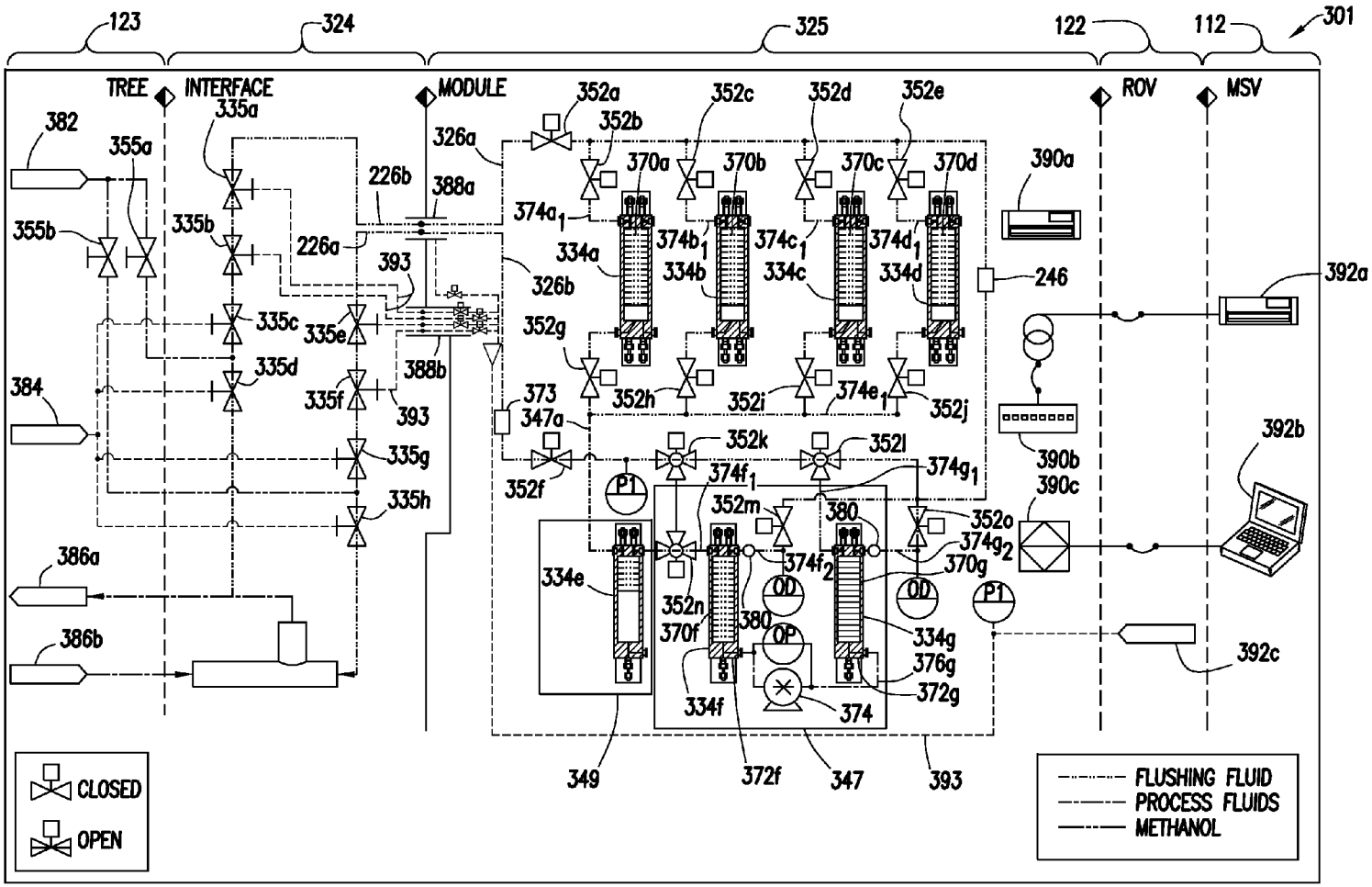

In a back flushing step of FIG. 3E, fluid is pumped from flushing unit 349 by pumping fluid in pumping unit 347 from buffer cavity 372*f* to buffer cavity 372*g*. This pumping action causes fluid to flow from sample cavity 370*g* out through flowline 326*b* and through (prouction flowline 386*b*. This step may also be performed by flushing the fluid out through flowline 326*a* and through production flowline 386*b* by closing valve 352*f* and opening valve 352*a*. Fluid may also be flushed through sample cavities 370*e,f,g* and discharged through flowline 226*b* of interface 324, out through the production flowline 386*a* and back to the subsea unit 116.

Figure 3F:
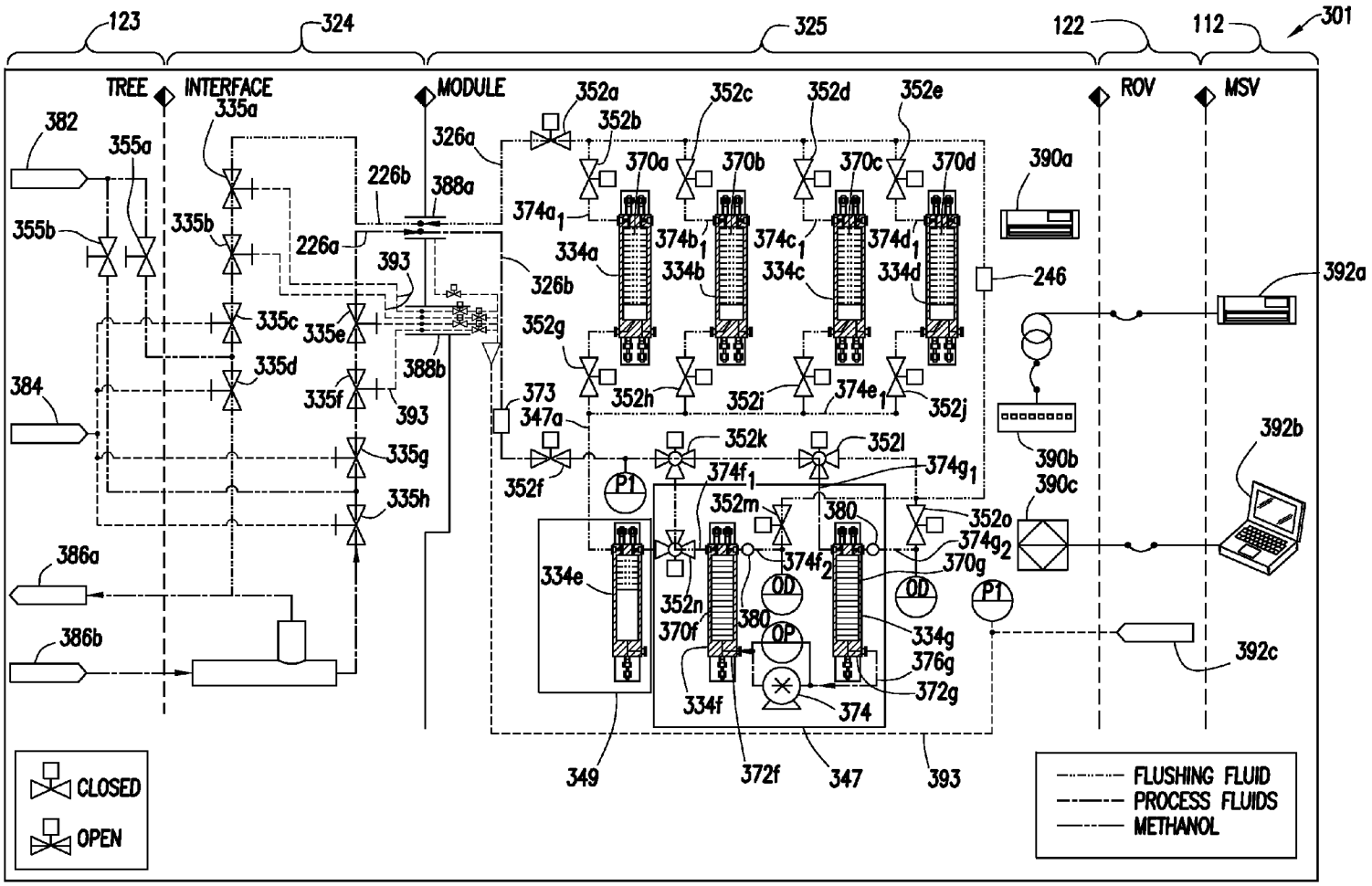

In an intake step of FIG. 3F, fluid is pumped by pump 347 from buffer cavity 372*g* into buffer cavity 372*f*. Valves 352*b-e,g-j,m* is closed and valves 352*a,f,k,l,n,o* are open. Valves 352*k, l* are redirected to fluidly connect sample cavities 370*f,g* to flowline 226*b* for drawing fluid into sample cavities 370*f,g*.

Figure 3G:
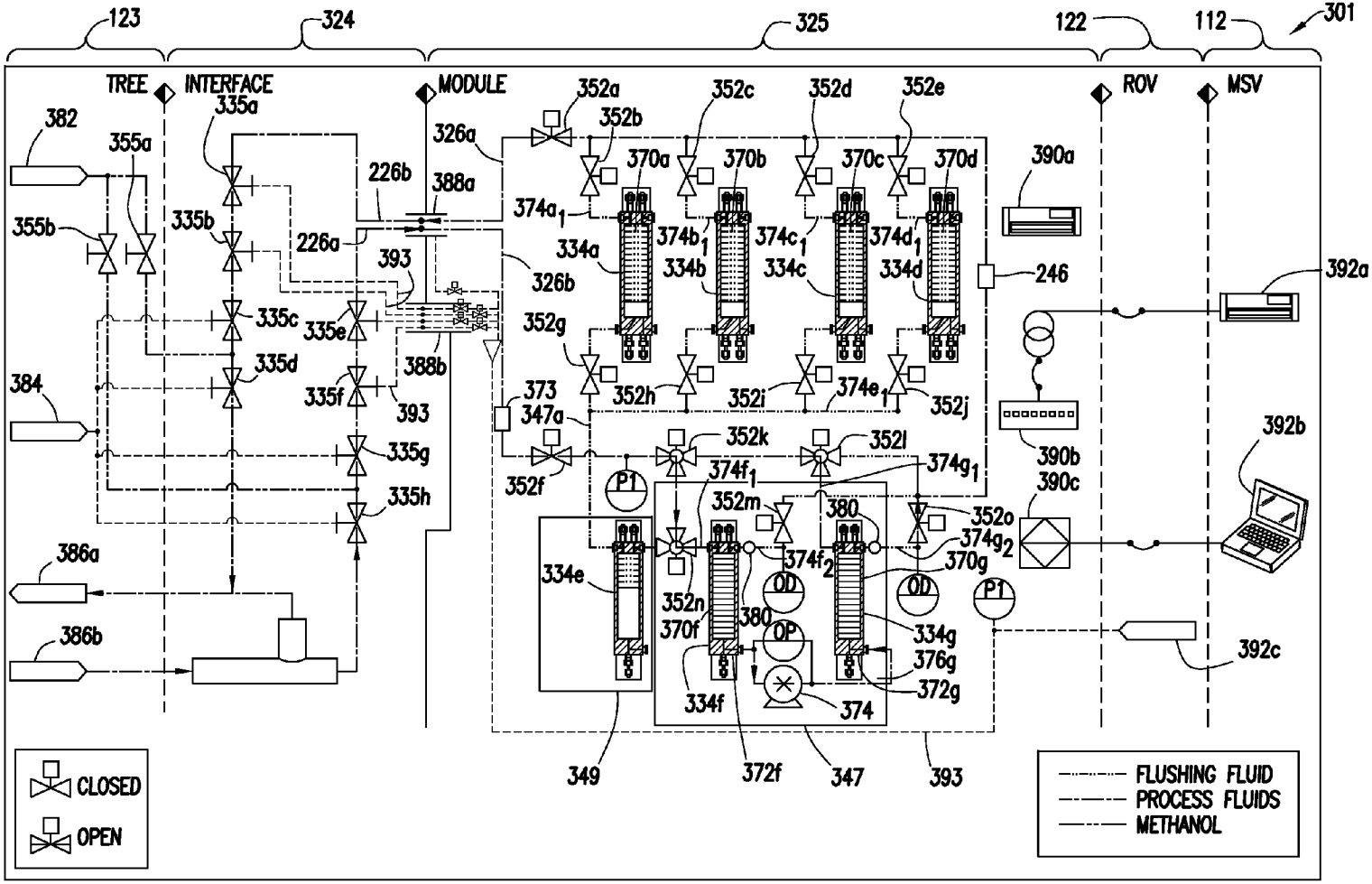

In another intake step of FIG. 3G, fluid is pumped by pump 347 from buffer cavity 372*f* into buffer cavity 372*g*. Valves 352*b-e,g-j,m* is closed and valves 352*a,f,k,l,n,o* are open. Valves 352*j,k,l* are redirected to fluidly connect sample cavities 370*f,g* to flowline 226*b* for drawing fluid into sample cavities 370*f,g*, and discharging fluid from fluid cavity 370*g* to flowline 226*a*.

Figure 3H:
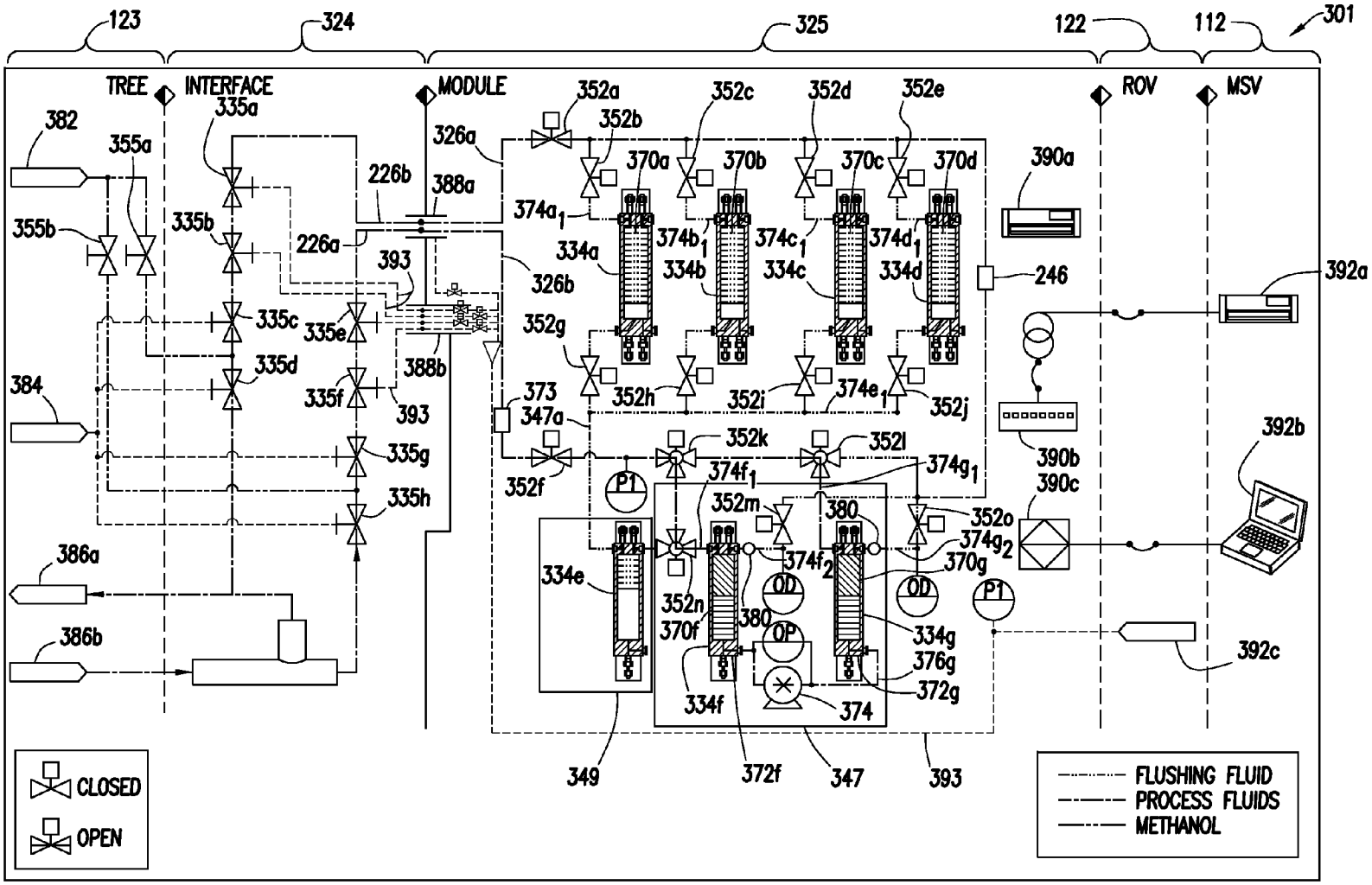

In FIG. 3H, pumping is completed, pump 347 is turned off. As fluid flows into the sample chambers 334*f,g*, the pistons 368*f,g* fall to receive sampling fluid into sample cavities 370*f,g*. While sample chambers 334*f,g* are depicted as having equal volumes of selected phases, any amounts may selectively be collected in any of the chambers.

Figure 3I:
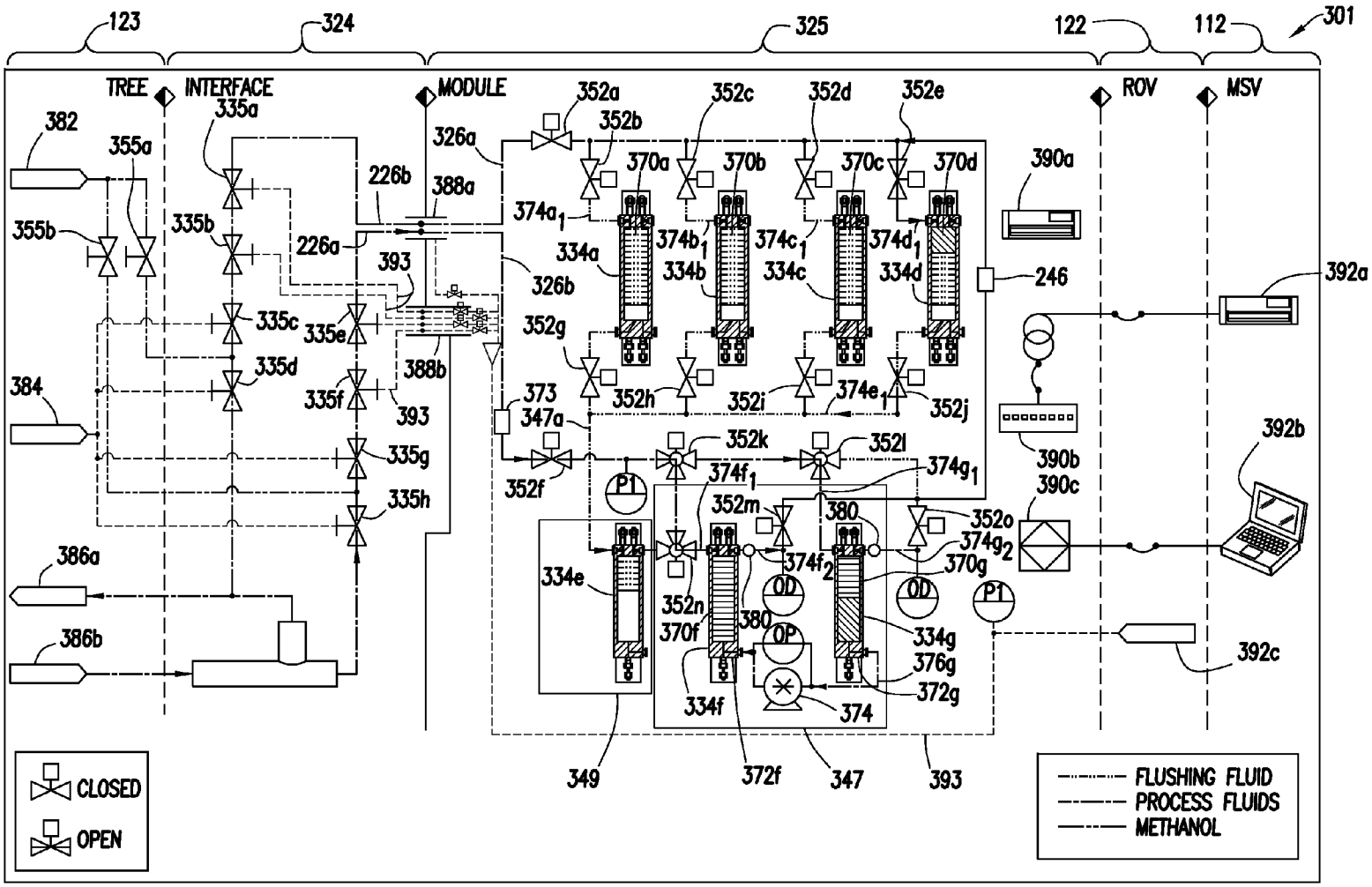

In a sampling step of FIG. 3I, valves 352*a-d,g-i,o* are closed, valves 352*e,f,j-n* are open, and valves 352*j,k* are redirected to allow fluid to flow from flowline 226*a* and into fluid cavity 370*g*. Buffer fluid from buffer cavity 372*g* passes into buffer cavity 372*f*. Fluid from fluid cavity 370*f* is passed into fluid cavity 370*d*. Buffer fluid from buffer cavity 372*d* is passed into fluid cavity 370*e*.

Figure 3J:
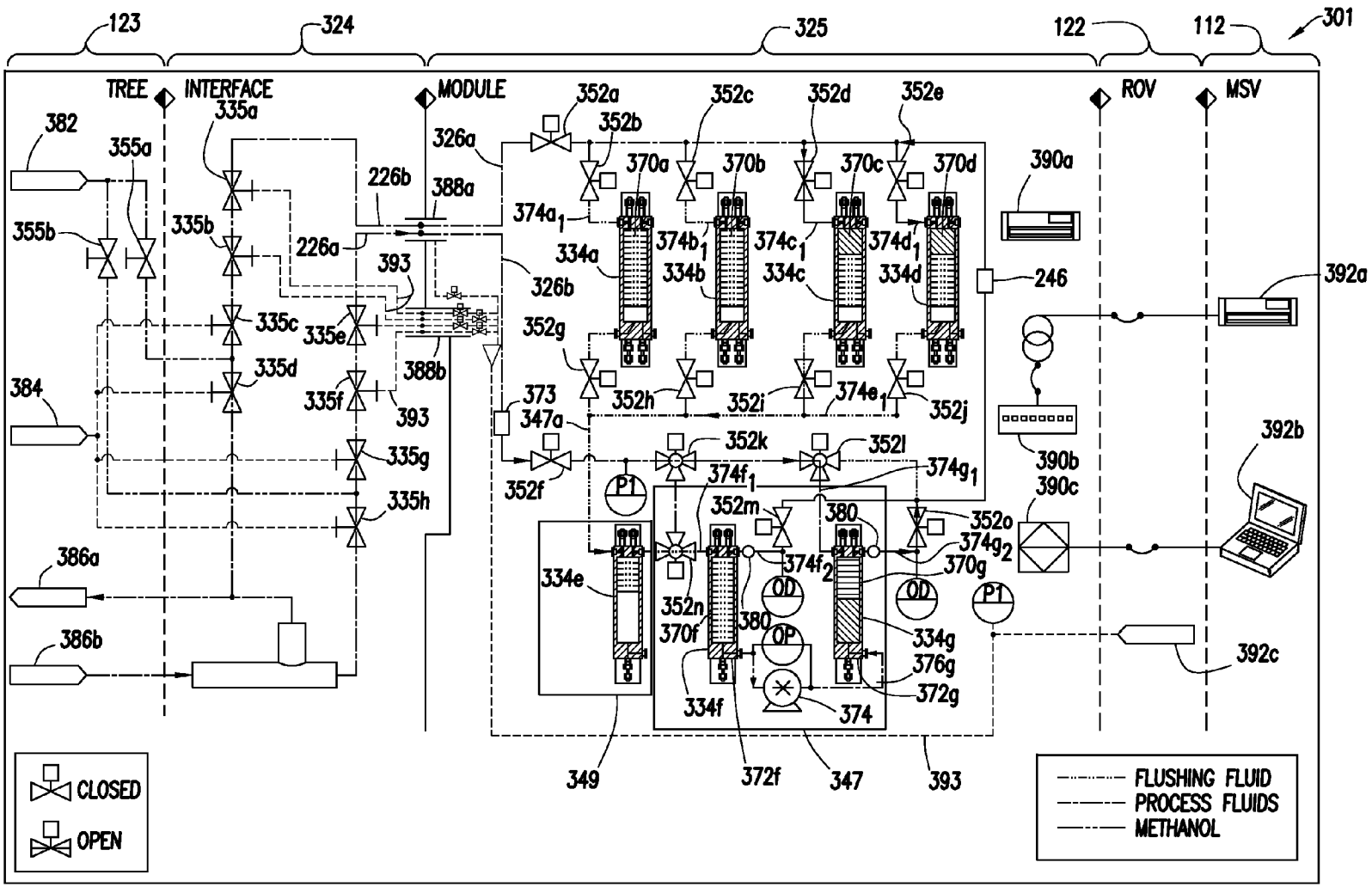
Figure 3K:
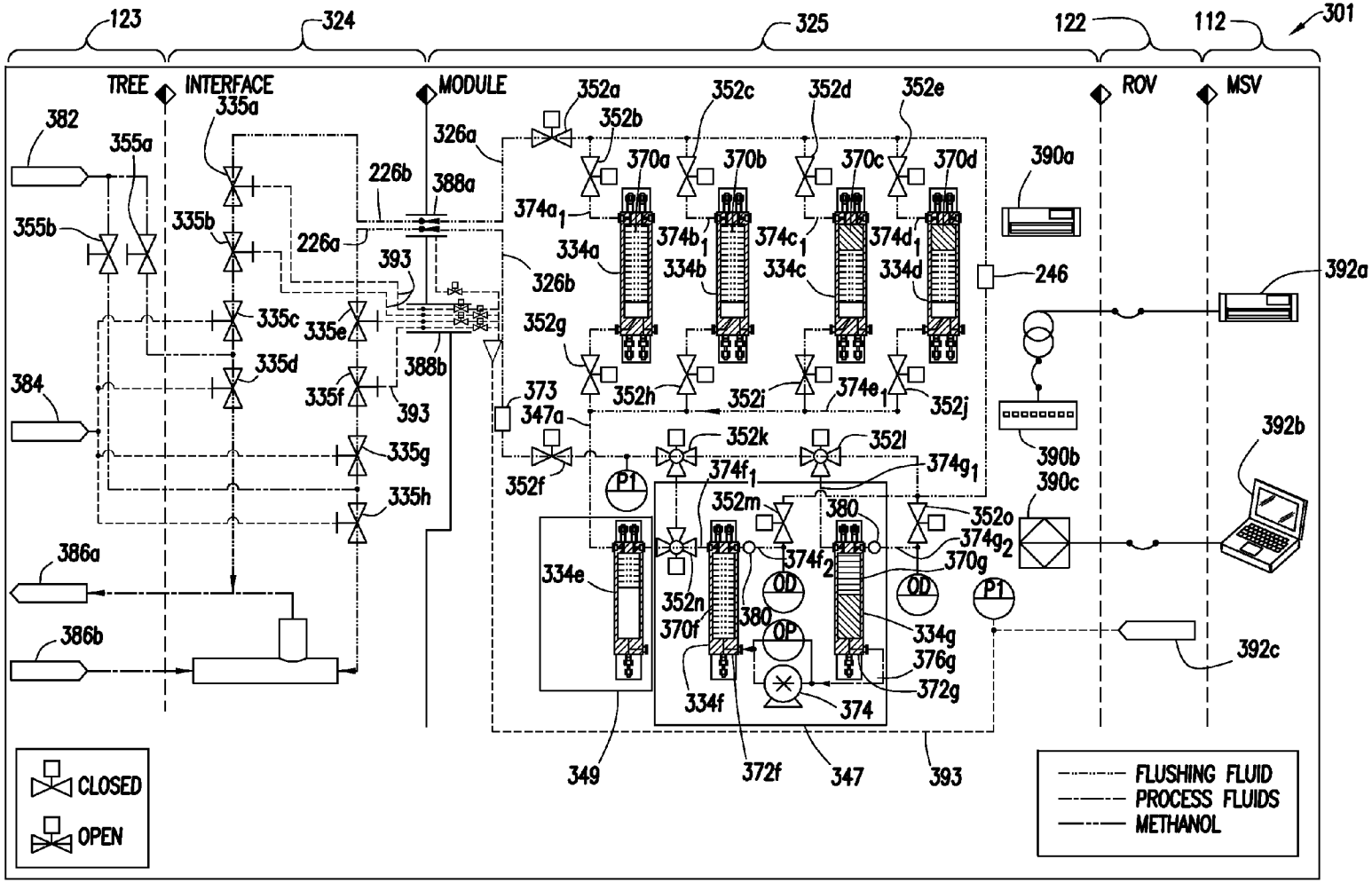

In another sampling step of FIG. 3J, valves 352*a-c,e,f,g,h, j,m* are closed, and valves 352*d,i,k,l,n,o* are opened. Buffer fluid from buffer cavity 372*f* passes into buffer cavity 372*g*. Fluid from fluid cavity 370*g* is passed into fluid cavity 370*e*. Buffer fluid from buffer cavity 372*d* is passed into sample chamber 334*e*. Valve 352*l* is diverted to allow fluid to flow from intake flowline 226*b* into sample chamber 334*g*. In a final flushing step of FIG. 3K, valves 352*a,f,i,k,l,n* are open, and valves 352*b-e,g-h,j,m,o* are closed. Valve 352*k* is redirected to fluidly connect sample cavities 370*e,f* to flowlines 226*b*. The steps may be repeated as desired to sample from one or more sample chambers 334. Additional steps may be performed to selectively divert fluid as desired and/or optionally to reverse flow.

Figure 4A:
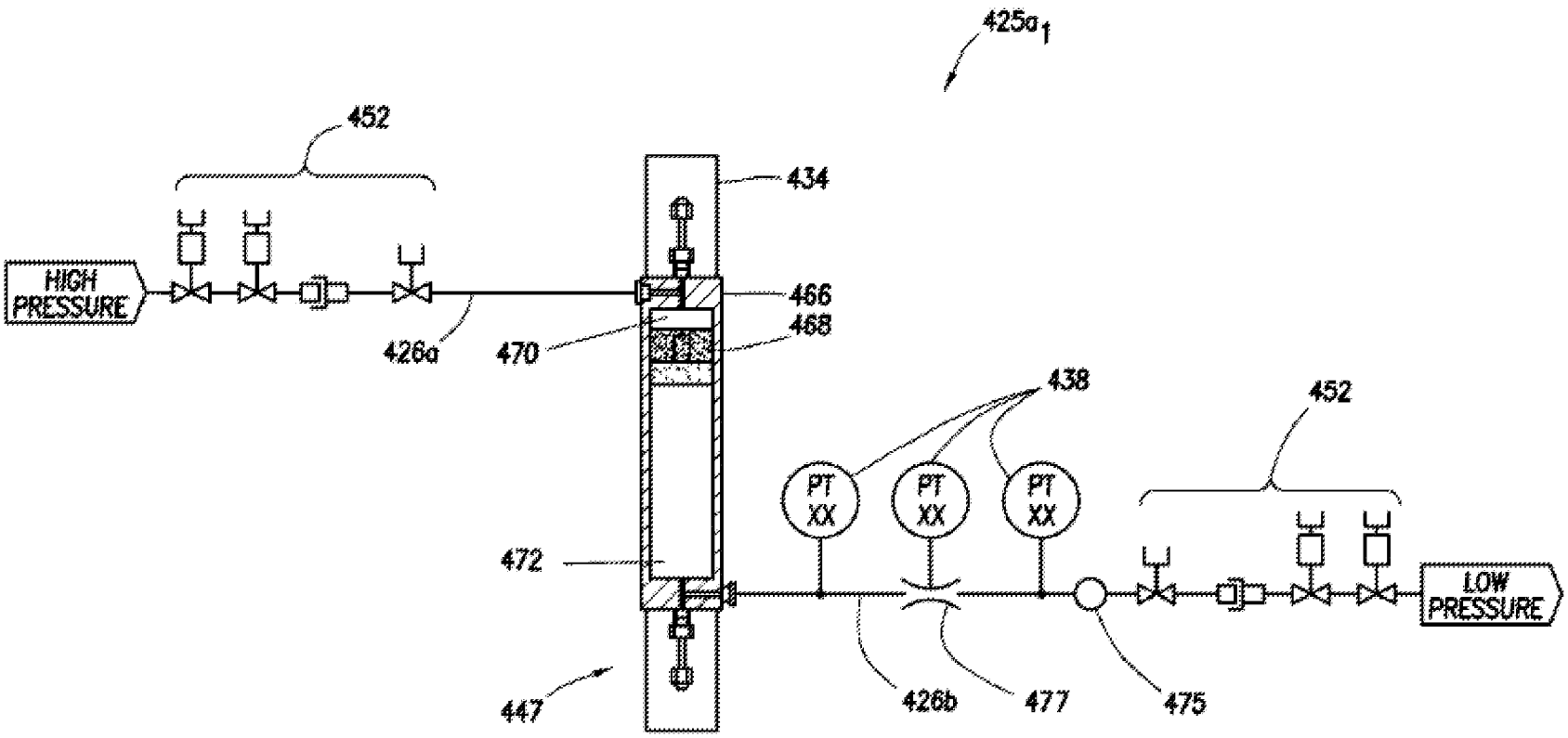
FIGS. 4A-4C are schematic views of a separation circuit with a single sample chamber pumping unit.
Figure 4B:
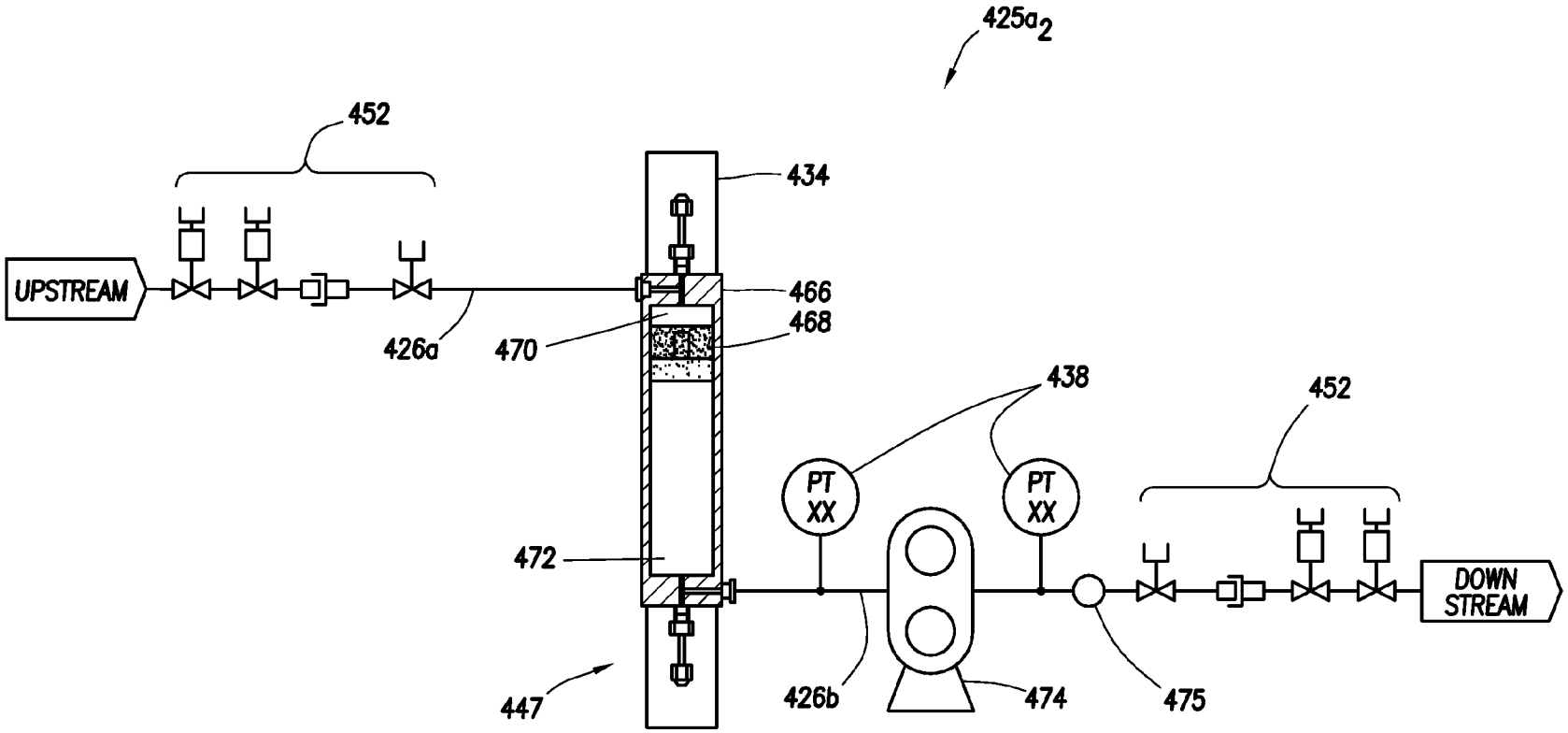
Figure 4C:
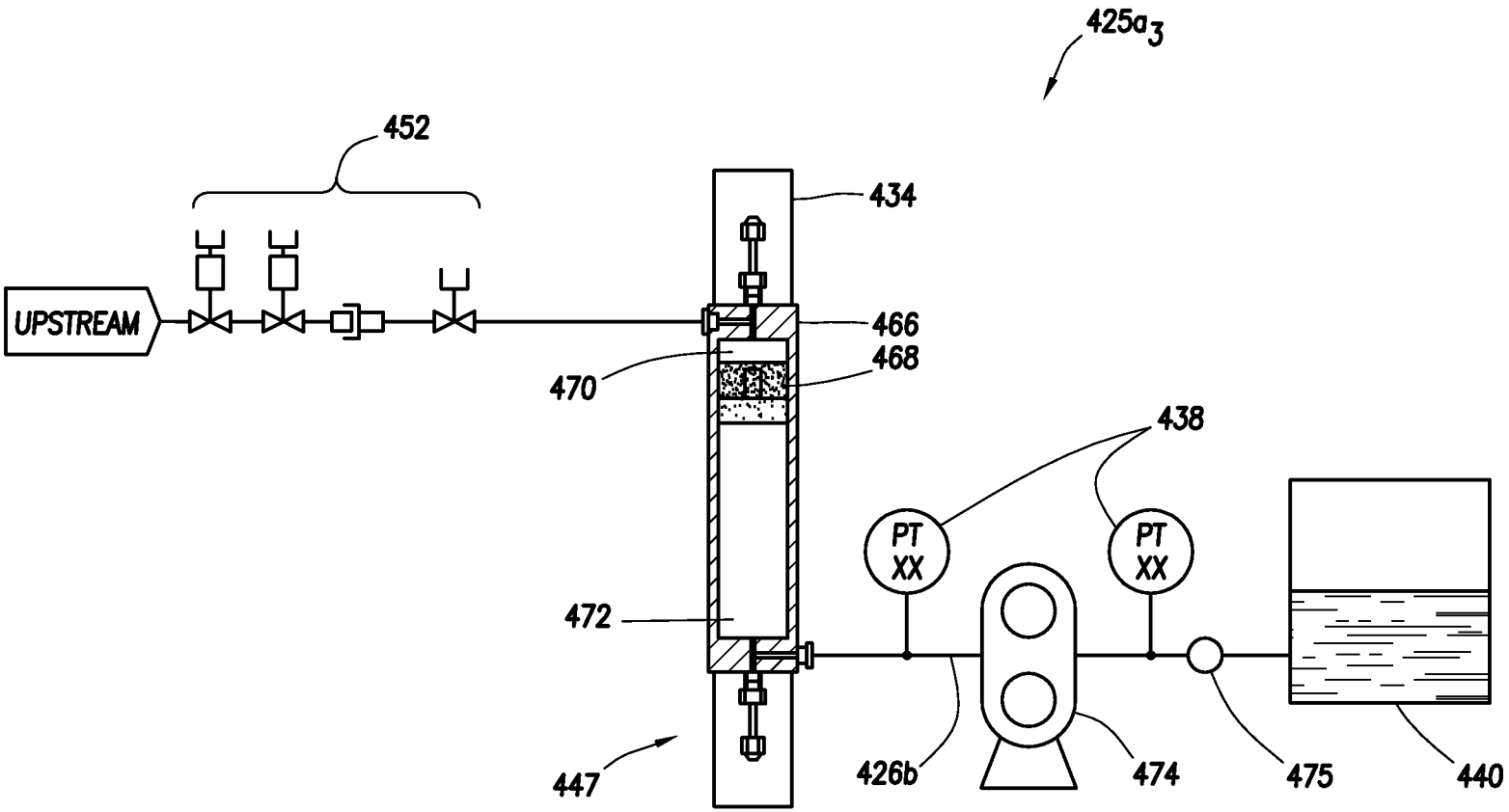

FIGS. 4A-4C are schematic views of a separation circuit 425*a*1-*a*3, respectively, each having a single pumping/sample chamber 434. The separations circuits 425*a*1-*a*3 may act as pumping units 447. Flow into the pumping/sample chamber 434 may be achieved by using differential pressure pumping as previously described with respect to FIG. 2. The pumping chambers have cylinders 466 with pistons 468 therein defining a fluid cavity 470 and a buffer cavity 472. Fluid from the wellbore (e.g., 120 of FIG. 1) may be drawn into intake flowline 426*a* and collected in the fluid cavity 470.

In the differential pressure configuration of FIG. 4A, the separation circuit 425 may be provided with a flow controller, such as orifice 477 , used in combination with valves 452 (or other proportional control device). The separation circuit 425a1 may be used to define a hydraulic fluid flow rate for buffer fluid to exit the buffer cavity 472 through outtake flowline 426*b*, thereby lowering the pressure in fluid cavity 470 and drawing fluid therein. The fluid drawn into the fluid cavity 470 may be permitted to separate into phases therein. The flow rate at which the buffer fluid exits the buffer cavity 472 may be used to define the rate that fluid can enter the fluid cavity 470. Sensors (or pressure gauges) 438 and/or a fluid monitor 475 may be provided for monitoring the flow through the pumping chamber 434.

Flow into the pumping/sample chamber 434 may also be achieved by pumping as shown in FIGS. 4B-4C. Using pump 474 to facilitate moving fluid in and out of the separation circuit 425 can be used, for example, when no differential pressure is available from the subsea unit 116. In the pumping configurations of FIGS. 4B and 4C, the separation circuits 425*a*2,*a*3 are provided with a hydraulic pump 474 fluidly connected to the buffer cavity 472. A sample may be collected in fluid cavity 470 by opening the inlet and outlet valves 452 of the separation circuit 425*a*1 and activating the pump 474. The pump 474 may be used to pull the hydraulic fluid out of the buffer cavity 470, which draws fluid into the fluid cavity 470 (similar to drawing fluid into a syringe). In FIG. 4B, the pump 474 is used to pump buffer fluid back out outtake flowline 226*b* as the sample is drawn into the fluid cavity 470. Valve 452 in flowline 426*b* may be activated to allow fluid flow to discharge through outtake flowline 426*b*. In FIG. 4C, the buffer fluid is pumped with a bi-directional pump 474 into a reservoir 440 for reuse.

Figure 5A:
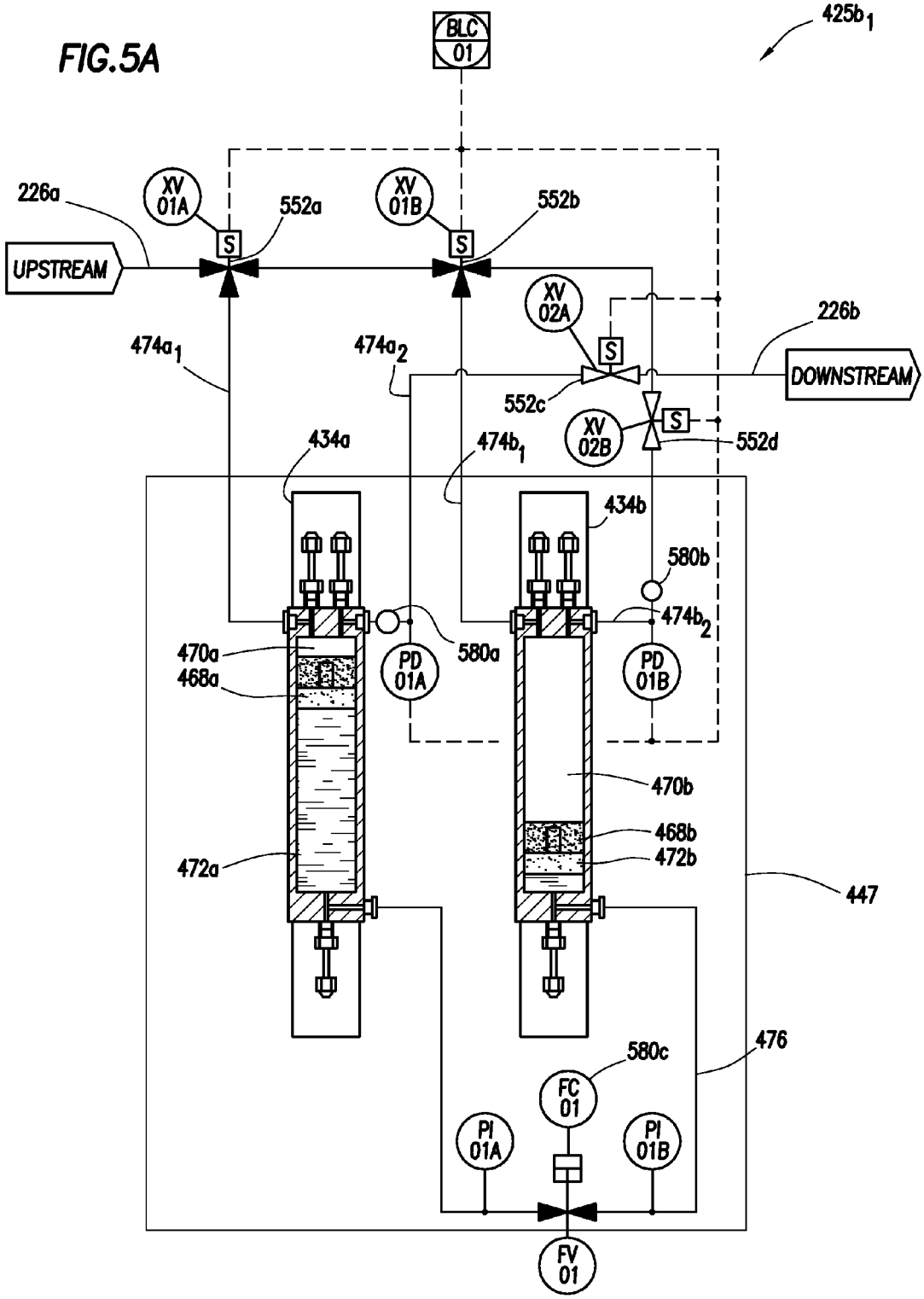
FIGS. 5A-5B are schematic views of a separation circuit with a dual sample chamber pumping unit.
Figure 5B:
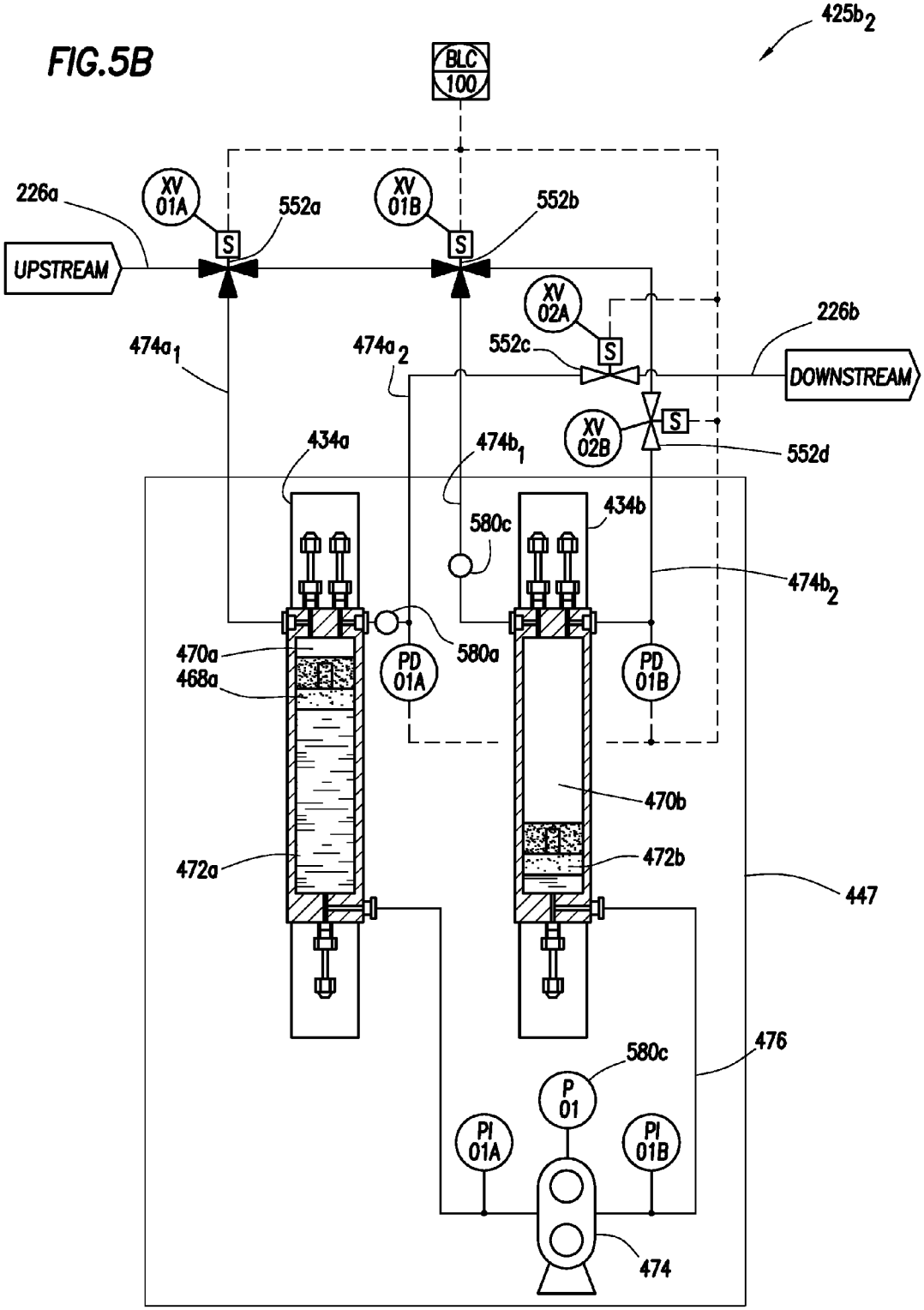

FIGS. 5A-5B are schematic views of a separation circuit 425*b*1,*b*2 having two pumping/sample chambers 434*a,b* that may form a pumping unit 447. In this version, the sample chambers 434*a,b* are connected in parallel. The fluid cavity 470*a* of the pumping/sample chamber 434*a* has two sample flowlines 474*a*1,*a*2, and the fluid cavity 470*b* of the sample chamber 434*b* has two sample flowlines 474*b*1, *b*2. The sample flowlines 474*a*1, *b*1,*b*2 are fluidly connected to the intake flowline 226*a* for passage of fluid into the sample cavity 470*a* for sampling. The sample flowline 474*a*2 is fluidly connected to the outtake flowline 226*b* for passage of fluid from the sample cavity 470*a* for discharge.

Each of the pumping/sample chambers 434*a,b* have a shared buffer flowline 476. The buffer flowline 476 fluidly connects the buffer cavity 472*a,b* of each of the sample chambers 434*a,b* to allow buffer fluid to pass therebetween. The buffer cavities 472*a,b* may be charged with, for example, about 50% buffer fluid. As fluid is drawn into one of the sample cavities 470*a,b* of one of the pumping/sample chambers 434*a,b*, buffer fluid may be passed between the buffer cavities 472*a,b* of each of the sample chambers 434*a,b* to adjust pressure therebetween. The buffer fluid may also be manipulated between the buffer cavities 472*a,b* to draw fluid into the sample cavities 470*a,b*.

Similar to the technique described with respect to FIG. 4A, flow into the pumping/sample chambers 434*a,b* may be achieved by using differential pressure pumping as shown in FIG. 4A. In the pressure differential configuration of FIG. 5A, differential pressure may be used as the motive force to drive the pistons 468*a,b* back and forth by selectively switching the inlet valves 552*a-b* (and optionally 552*c-d*) and creating a pumping action. The upstream pressure from intake flowline 226*a* may be used to push the piston 468*a* down while collecting the well fluid in sample cavity 470*a* and transferring the hydraulic fluid between buffer cavities 472*a,b*. This will then lift the piston 468*b* in sample chamber 434*b* to discharge the well fluid out of sample cavity 470*b*.

The fluid drawn into the sample cavities 470*a,b* may be permitted to gravitationally separate. As fluid separates, fluid may be selectively passed from the sample cavities 470*a,b* and monitored by sensors (or phase detectors) 580*a,b*. Sensors 580*a,b* may be provided to measure or detect the phases of the fluid during the discharge cycle at the outlet of a sample cavity 470*a,b*. Output from the sensors 580*a,b* may be used to activate the movement of the sample chambers to pump fluid through the pumping/sample chambers 434*a,b* to capture selected phases of the fluid. Sensor 580*c* may also be provided to monitor the buffer fluid. The sensor 580*c* may also be used to activate reverse pumping action when a single target phase concentration is required, or switch the outlet flow to a separate downstream collection vessel (not shown) designated for the collection of the detected phase.

The separation circuit 425*b*1 may be flow controlled to help determine the rate that the sample is collected. Sampling rates for this type of system may range from about 0.1 liters/min to about 20 liters/min. In cases where the separation circuit system 425*b*1 is used for water phase sample collection and the well fluid flow has very low water cut, full cylinder cycling may need to be reduced until sufficient water is collected in the pumping/sample chamber 434*a,b* to overcome system detection response times and dead spaces that may exist in an upper portion of the pumping/sample chamber 434*a,b* and associated piping and valves upstream of the separation circuit 425*b*1.

Similar to the technique described with respect to FIGS. 4B-4C, flow into the pumping/sample chamber 434*a,b* may be achieved by pumping as shown in FIG. 5B. In the pumping configuration of FIG. 5B, the separation circuit 425*b*2 is provided with a hydraulic pump 474 fluidly connected to the buffer flowline 476. A sample may be collected in sample cavity 470*a* by opening the inlet and outlet valves 552*a,b* of the separation circuit 425*b*2 and activating the pump 474. The pump 474 may be used to pull the hydraulic fluid out of the buffer cavity 472*a* which is replaced by an equal volume of sampled fluid in the sample cavity 470*a* (similar to drawing fluid into a syringe). In FIG. 5B, the pump 474 is used to pump buffer fluid between buffer cavities 472*a,b*.

The pumping/sample chambers 434 *a,b* can also be piston type sample chambers used to help control sample pressures. Sample cavity 470*a* of chamber 434*a* may be charged with 100% hydraulic fluid, while sample cavity 470*b* of sample chamber 434*b* may be charged with 0% buffer fluid. Valves 552*a,b* may be opened to permit fluid from intake flowline 226 to enter sample cavities 470*a,b*. Valve 552*c* may be selectively adjusted to control the rate of hydraulic fluid (which in turn controls the sampling fluid(s) volumetric rate). The hydraulic fluid may be allowed to flow until, for example, the total hydraulic fluid is transferred. The transfer may be verified by hydraulic fluid totalized or loss of flow through sensor 580*b*. A sensor 580*c* may detect the selected phase or desired interface discharged from the sample cavity 470*a*, or a predetermined amount of hydraulic fluid is transferred based on a short cycling time requirement (i.e. low water cut fluid for a "water only sample").

Once operation is complete, valves 552*a,b* may be closed, and the cycle reversed. Valves 552*a,b* may then be re-opened. Valve 552*c* may be left in the previous position or changed as necessary depending on the cycle time from the previous cylinder cycle. Cycling and sampling may continue in this alternating sequence until a desired quantity of selected phase is captured. The hydraulics from the sample chambers 434*a,b* may be discharged out outtake flowline 226*b*, or recycled back to a hydraulic system for use when the sample chambers are discharged for analysis.

Figure 6:
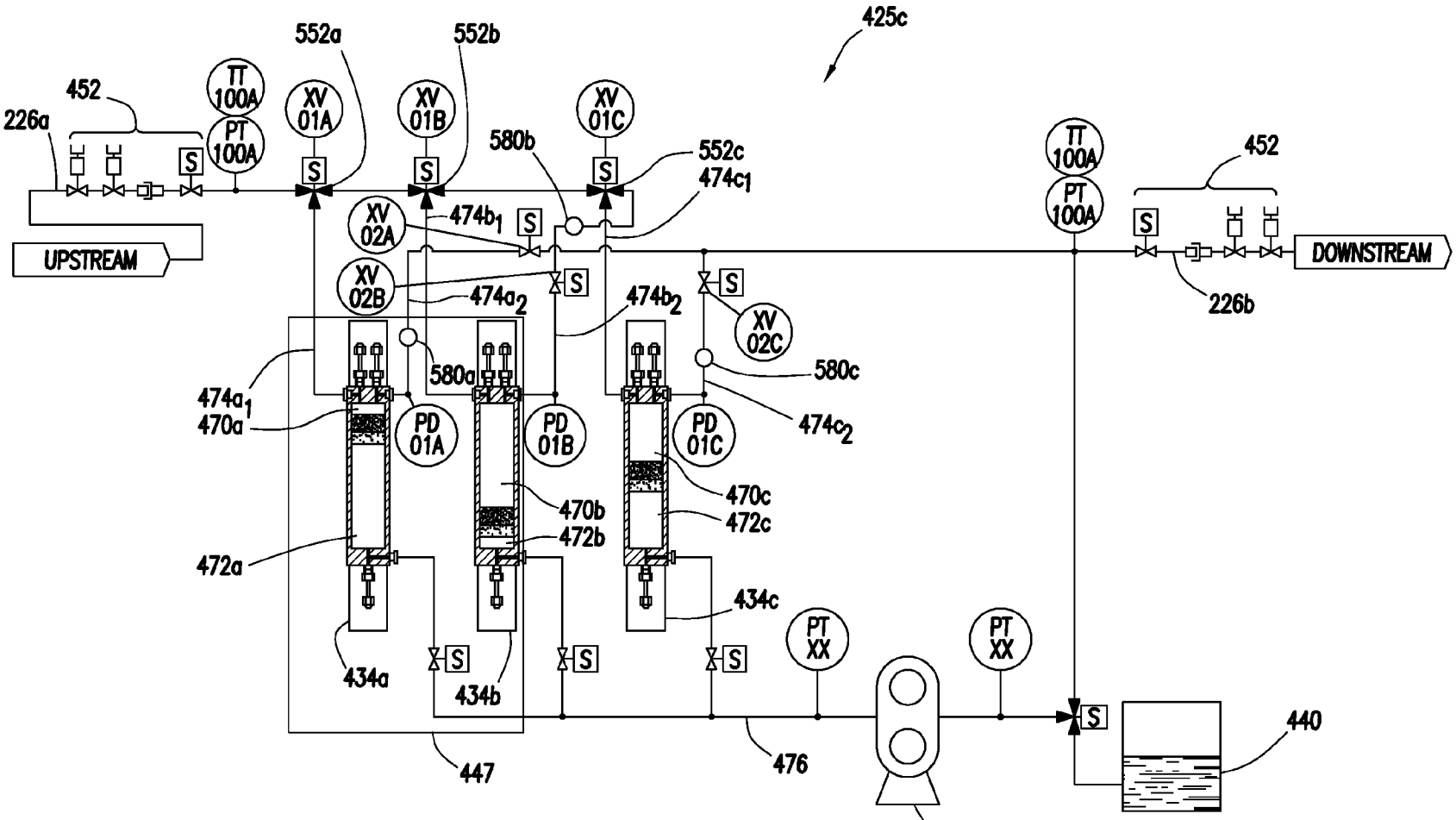
FIG. 6 is a schematic view of a separation circuit with a triple sample chamber pumping unit.

FIG. 6 is a schematic view of a separation circuit 425*c* having three sample chambers 434*a-c*. Sample chambers 434*a,b* act as pumping unit 447, while sample chamber 434*c* collects samples of fluid. In this version, multiple sample chambers 434*a,b,c* may be connected in parallel. The sample cavity 470*a* of the sample chamber 434*a* has two sample flowlines 474*a*1,*a*2, the sample cavity 470*b* of the sample chamber 434*b* has two sample flowlines 474*b*1, *b*2, and the sample cavity 470*c* of the sample chamber 434*c* has two sample flowlines 474*c*1, *c*2. The sample flowlines 474*a*1,*b*1, *c*1 are fluidly connected to the intake flowline 226*a* for passage of fluid into the sample cavities 470*a,b,c* for sampling. The sample flowlines 474*a*2,*b*2,*c*2 are fluidly connected to the outtake flowline 226*b* for passage of fluid from the sample cavity 470*a,b,c* for discharge.

Each of the sample chambers 434*a,b,c* have a shared buffer flowline 476. The buffer flowline 476 fluidly connects the buffer cavity 472*a,b,c* of each of the sample chambers 434*a, b,c* to allow buffer fluid to pass therebetween. The buffer flowline 476 may also be fluidly linked to outtake flowline 226*b*. As fluid is drawn into sample cavities 470*a,b,c* of the sample chambers 434*a,b*, buffer fluid may be passed between the buffer cavities 472*a,b* of each of the sample chambers 434*a,b*, or discharged to outtake flowline 226*b* to adjust pressure therebetween. Buffer fluid may optionally be passed to fluid tank 440 for storage and reuse.

The separation circuit 425*c* may use pump 474 to pump buffer fluid through outtake flowline 226*b* or to the hydraulic reservoir 440. The hydraulic reservoir 440 may be used, for example, when a sample is concentrated with a particular fluid phase. Sensors (e.g., phase detector) 580*a,b,c* in flowline 474*a*2,*b*2,*c*2 to detect fluid exiting sample cavity 470*a,b,c*, in a similar manner as the separation circuit 425*b*2 of FIG. 5B. The fluid in the pumping chamber(s) 434*a-b* may be allowed to separate. Once a desired phase is detected by the sensor(s) 580*a-c*, fluid may be captured in one of the sample chambers 434*a-c*, or in one or more additional sample chambers (not shown). Valves 552*a-r* or other valves, such as valves 452, may be activated to selectively divert the fluid to capture the desired samples.

Figure 7:
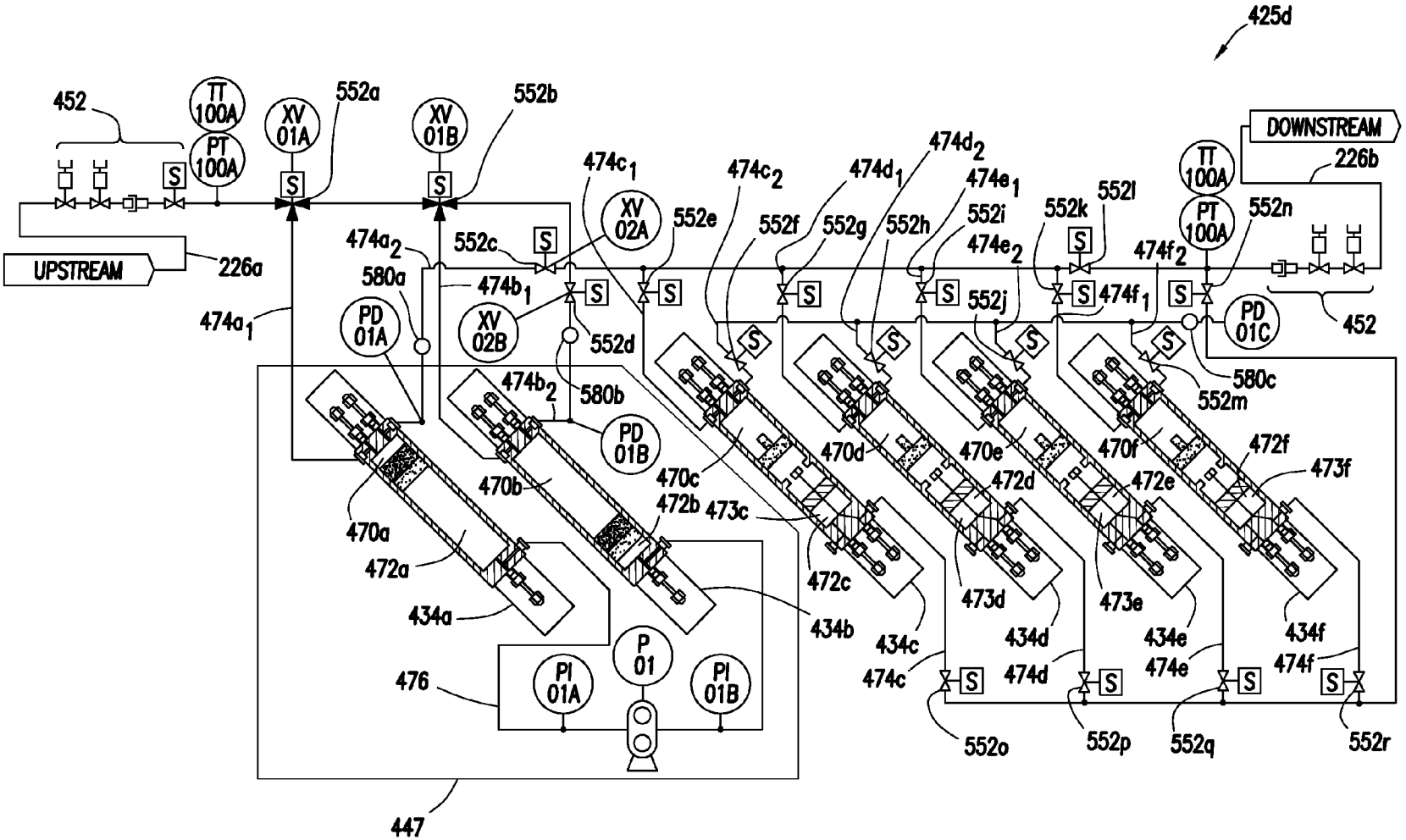
FIG. 7 is a schematic view of a separation circuit with a multiple sample chamber pumping unit.

FIG. 7 is a schematic view of a complex separation circuit 425*d* having multiple pumping and sample chambers 434*a-f* in a sample storage configuration. In this version, multiple pumping chambers 434*a-b* are connected in parallel, and sample chambers 434*c-f* are connected in series. The sample chambers 434*a,b* form the pumping unit 447 for selectively drawing fluid through the separation circuit 425*d*. One or more sample chambers 434*c-f* may be used to collect samples of separated fluid.

The sample cavity 470*a-f* of each of the sample chambers 434*a-f* has a flowline 474*a*1-*f*1 and a flowline 474*a*2-*f*2. The flowlines 474*a*1,*b*1,*b*2 are fluidly connected to the intake flowline 226*a* for passage of fluid into the sample cavities 470*a-f* for sampling. The sample flowlines 474*a*2, *b*2,*c*1-*f*1, *c*1-*f*2 are fluidly connected to the outtake flowline 226*b* for passage of fluid from the sample cavity 470*a-f* for discharge.

Buffer cavities 472*a,b* of the sample chambers 434*a-b* are fluidly connected by a buffer flowline 476. Each of the sample chambers 434*c-f* have a buffer flowline 474*c-f* fluidly connected to outtake flowline 226*b*. The flowlines 474*c-f* fluidly connect the buffer cavities 472*c-f* of their respective sample chambers 434*c-f* to allow buffer fluid to pass therebetween.

In the sampling configuration of FIG. 7, sample chambers 434*a,b* act as pump 447 to reciprocate and draw fluid from intake flowline 226*a*. Fluid may be selectively drawn into sample cavities 470*a,b* and/or withdrawn from buffer cavities 472*a,b*. The reciprocating action of the sample chambers 434*a,b* may be used to selectively pump fluid from sample cavities 470*a,b* into one or more of the sample cavities 470*c-f* of sample chambers 434*c-f*. A pump 474 may be provided in the buffer flowline 476 to draw fluid into the sample cavities 470*a,b*.

Fluid passed into sample cavities 470*c-f* of sample chambers 434*c-f* may be stored or discharged through outtake flowline 226*b*. As fluid is passed into sample cavities 470*c-f*, buffer fluid may be discharged to outtake flowline 226*b* through buffer flowlines 474*c-f*. The selective reciprocation may be used to selectively discharge portions of the fluid that may gravitationally separate in the sample cavities 470*c-f*. The pumping and/or sample chambers 434*a-f* may be tilted to facilitate separation and/or diversion of separated fluid.

As also depicted in FIG. 7, the sample chambers 434*c-f* may optionally have flushing fluids in charging chambers 473*c-f*. While certain sample chambers 434*a-f* are shown for pumping and for storage, any number of sample chambers 434*a-f* may be used in various arrangements to pump and collect fluid. Sensors 580*a-c* may be provided to detect the phases of the fluid passing through the sample cavities 470*a-f* to detect desired phases for collection. Valves 552*a,b* or other valves may be selectively activated based on the detect fluid to divert fluid to sample cavities 434*c-f* for collection, or to discharge fluid through outtake flowline 226*b*.

The sample chambers described herein may be used to pump and/or store fluid. For example, the sample chambers may be arranged to provide for the segregation of the multiphase fluid when, for example, a "water only" sample is desired. Sample chambers herein may function as a dual action pump into a selected sample chamber for storage. As the fluid flows into a selected storage sample chamber, the water phase may separate from the fluid and settle to the bottom of the sample chamber while the oil and gas phase may be slowly discharged out the top and back into the production flow. The angle of the storage cylinder may be positioned to optimize separation. The angle may be selected to take advantage of a 'boycott effect' during phase separation.

The sample chambers described herein may optionally have flushing fluids in charging chambers. The sample chambers (or sample storage cylinders or storage bottles) used herein can be of several different types and orientation. Sample chambers may be single piston, dual piston or non-piston type. The orientation of the cylinders may be positioned in a vertical or angled position. The degree of angle that the sample chamber may be positioned may be selected based on the functionality and efficiency of intended performance or use, or to reduce the height of the sample chamber within a confined or limited space.

Sample chambers used for sampling and/or storing may be of a single phase fluid design or a multiphase fluid design. The sample chambers may also be designed and certified for department of transportation (DOT) requirements, for example, if the samples are retrieved and transported for analysis. Sample chambers may also be used with an auto-closing feature which isolates and closes the cylinder when a predefined quantity of fluid has been captured in the sample chamber. Such auto-closing features can be incorporated in the design and used when increased safety is desired during the sampling process.

The sampling systems herein may use segregated samples, concentrated or phase enhanced samples, and/or well flow representative samples. Segregated samples may involve phase segregated samples where the phases of the multiphase fluid may be separated inside the sample bottles. These segregated samples may be transported in the sample chamber to an analysis lab, or can be further processed by a decanting procedure with the sampling system.

Concentrated or phase enhanced samples may be used where a single phase is needed for analysis. The sample collected may be enhanced during the cycling or discharge cycle using a phase detector. The sampling system can detect phases selected during a cylinder discharge cycle and divert that phase to a sample chamber (e.g., 334*e*) for discharging the oil and gas.

Well flow representative samples may involve selection of a sampling interface location or utilization of a permanent or insertable probe into a wellhead. It may be possible to obtain fluid in the sampling flow line with correct phase volume proportion to the main flow line. Various phases (e.g., gas, oil, water, etc.) may be present; however, in some cases only water cut (Vw/(Vo+Vw)) or GVF (Vg/(Vo+Vw+Vg)) may be obtained. Empirical correlations may be developed to establish a systematic deviation between sample line phase volumetrics and main line volumetrics such that main line phase volumes can be determined from sample line volumes.

Collection of samples for phase volume determination may be obtained in a "one shot" sample, whereby the fluid may be extracted from the main flow line at a set rate of displacement to fill a single sample chamber in a single cycle of a sample chamber piston. A sample cavity may then be isolated and phase volumes determined either in situ (subsea) or at surface or after transport to a laboratory.

Figure 8:
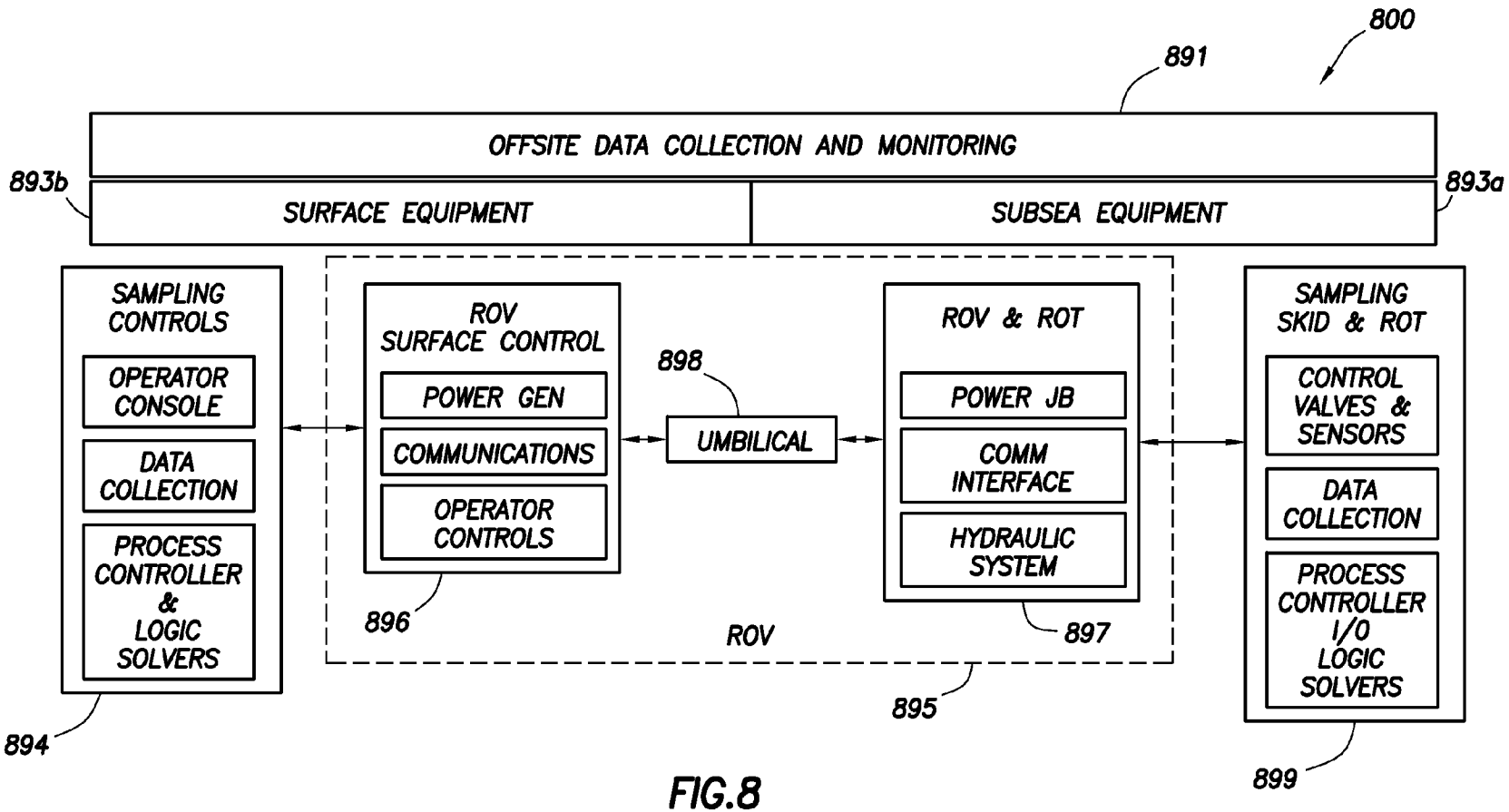
FIG. 8 is a schematic diagram depicting a sample control architecture.

FIG. 8 is a schematic diagram depicting a sampling tool 800 usable with the surface unit 112 of FIG. 1. The various controls and components of FIG. 8 may be used to control the operation of the sampling systems herein. These controls and components may be used, for example, to activate the surface unit 112, ROV 122, sampling system 101 and/or port 123. The sensors used herein may send signals to the sampling tool 800 and flow control devices, such as valves and pumps, may be activated to divert fluid for separation and sampling. Part or all of the sampling tool 800 may be positioned in various locations about the wellsite for operation of desired components. The sampling tool 800 may gather information, make decisions, send commands and/or perform operations as desired.

The sampling tool 800 may include sampling controls 894, ROV controls 895, sampling skid & ROT controls 899, offsite data collection and monitoring 891, surface equipment 893*b*, and subsea equipment 893*a*. The sampling controls 894 may include sampling components, such as operator controls, data collection, and process controller & logic solvers. The sampling skid & ROT control 899 may include skid components, such as control valves & sensors, data collection, process controller, I/O, and logic solvers.

The ROV controls 895 may include ROV surface control 896, and ROV & ROT control 897 linked by an umbilical 898. The ROV surface control may include ROV components, such as power generators, communications, operator controls. The ROV & ROT control 892 may include power JP, communication interface and hydraulic systems.

Figure 9:
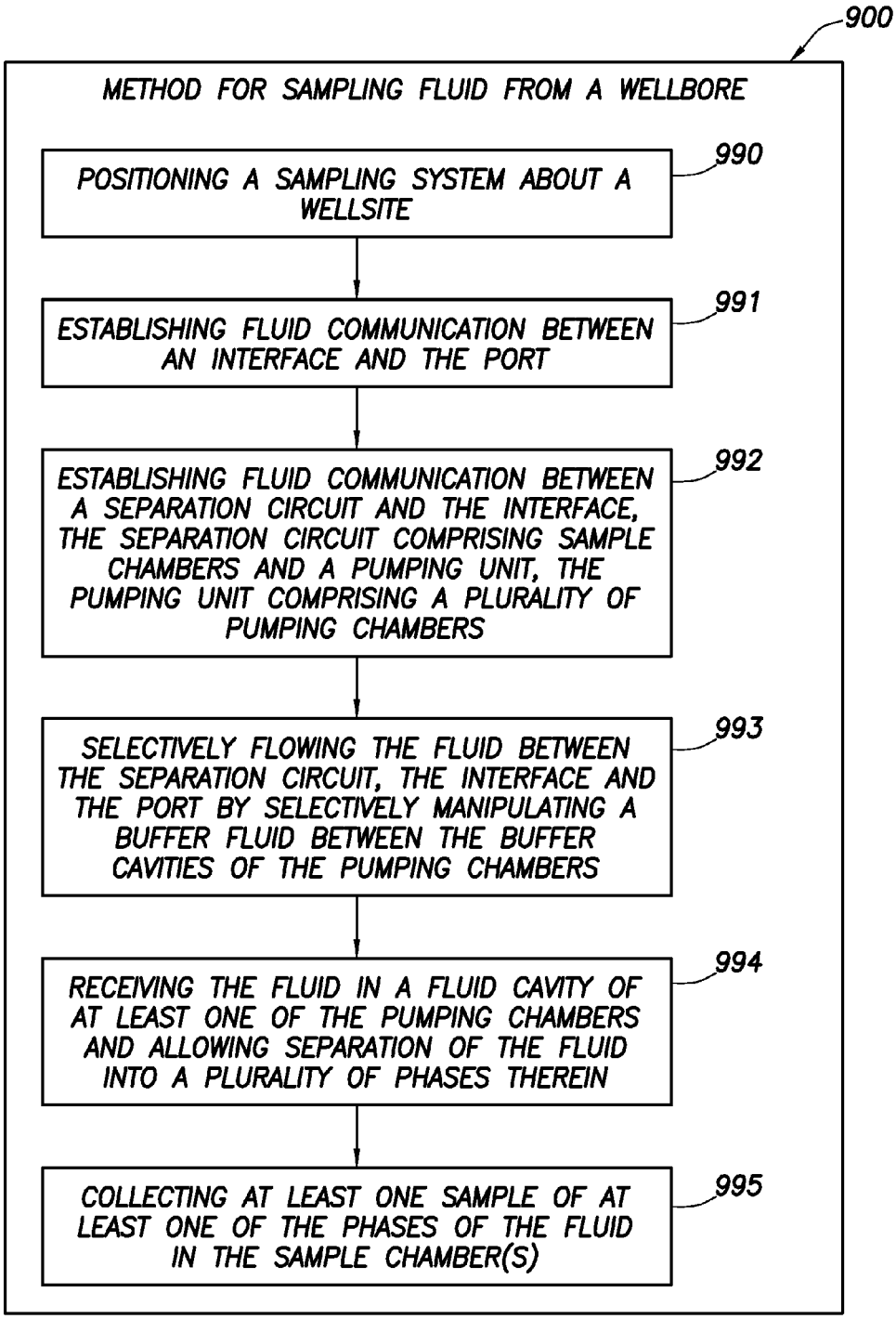
FIG. 9 is a flow chart of a method of sampling a fluid from a production wellsite.

FIG. 9 depicts a method 900 for sampling fluid from a wellbore. The method may involve positioning (990) a sampling system about a wellsite (e.g., deploying via an ROV), establishing (991) fluid communication between an interface and the port, establishing (992) fluid communication between a separation circuit and the interface (the separation circuit comprising at least one sample chamber and a pumping unit, the pumping unit comprising a plurality of pumping chambers, the plurality of pumping chambers each having cylinder with a piston therein defining a fluid cavity and a buffer cavity), selectively flowing (993) the fluid between the separation circuit, the interface and the port at a controlled rate (e.g., flow rate and/or pressure) by selectively manipulating the buffer fluid between the buffer cavities of the plurality of pumping chambers, receiving (994) the fluid in the fluid cavity of at least one of the plurality of pumping chambers and allowing separation of the fluid into a plurality of phases therein, and collecting (995) at least one sample of at least one of the plurality of phases of the fluid in the at least one sample chamber. The buffer fluid may be selectively manipulated using a pressure differential across the port, and/or selectively manipulated using a pump.

The method may also involve electrically connecting the separation circuit to the interface and the port for selective activation thereof, deploying at least a portion of the separation circuit with a remote operated vehicle deployed from a surface unit, retrieving at least a portion of the separation circuit with a remote operated vehicle deployed from a surface unit, flushing at least a portion of the fluid from the separation circuit, performing at least one pressure test, and/or passing the downhole fluid through a fluid separator. The steps may be performed in various orders and repeated as desired.

While the present disclosure describes specific aspects of the invention, numerous modifications and variations will become apparent to those skilled in the art after studying the disclosure, including use of equivalent functional and/or structural substitutes for elements described herein. For example, the sampling system herein may use one or more pumping chambers in various circuit arrangements to selectively separate and/or manipulate fluid flow into one or more sample chambers for sampling.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. A system for sampling fluid from a production wellsite, the production wellsite having a tubular extending into a subsea unit for producing a fluid therefrom and a port at the wellsite for accessing the fluid, the system comprising:

an interface operatively connectable to the port for establishing fluid communication therewith;

a separation circuit operatively connectable to the interface for establishing fluid communication with the interface and the port, the separation circuit comprising:

a pumping unit comprising a plurality of pumping chambers, each of the plurality of pumping chambers having a cylinder with a piston therein defining a fluid cavity and a buffer cavity, each of the fluid cavities defining a separation chamber for receiving the fluid and allowing separation of the fluid therein into a plurality of phases, each of the buffer cavities having a buffer fluid selectively movable therebetween whereby the fluid flows through the separation circuit at a controlled rate; and at least one sample chamber for collecting at least one sample of the plurality of phases of the fluid;

wherein a first buffer cavity is adapted to discharge buffer fluid to an outtake flowline in response to a first fluid cavity receiving fluid while a second buffer cavity is discharging buffer fluid to the outtake flowline in response to a second fluid cavity receiving fluid.

2. The system of claim 1, further comprising a fluid separator.

3. The system of claim 2, wherein the fluid separator is upstream of the pumping unit.

4. The system of claim 2, wherein the fluid separator is downstream of the pumping unit.

5. The system of claim 1, further comprising at least one sensor for detecting one of density, flow rate, pressure, temperature, composition, phase and combinations thereof.

6. The system of claim 1, further comprising a pump for selectively moving the buffer fluid between the buffer cavities.

7. The system of claim 1, wherein the pumping unit utilizes a pressure differential at the port for selectively moving the buffer fluid between the buffer cavities.

8. The system of claim 1, further comprising a flushing unit for flushing fluid through the separation circuit.

9. The system of claim 1, further comprising a remote operated vehicle operatively connectable to the separation circuit.

10. The system of claim 1, further comprising a surface unit operatively connectable to the separation circuit.

11. The system of claim 1, wherein operatively connectable comprises one of hydraulically connectable, electrically connectable, and combinations thereof.

12. The system of claim 1, further comprising a plurality of valves for selectively diverting fluid through the separation circuit.

13. The system of claim 1, further comprising at least one fluid control component comprising one of at least one pressure transmitter, at least one temperature sensor, at least one orifice, at least one restrictor, at least one probe, at least one meter, at least one flow diverter, at least one valve, at least one pump, at least one fluid separator, at least one flowline, and combinations thereof.

14. The system of claim 1, further comprising an electrical component for operating the separation circuit.

15. The system of claim 1, further comprising a retrievable skid for housing the interface and the separation circuit.

16. The system of claim 1, further comprising a sand filter.

17. The system of claim 1, further comprising a temperature controller for selectively controlling a temperature of the fluid.

18. The system of claim 1, wherein the plurality of phases comprise at least two of water, gas, oil, sand and combinations thereof.

19. The system of claim 1, wherein the plurality of pumping chambers are positioned at an angle to facilitate separation therein.

20. A method of sampling fluid from a production wellsite, the production wellsite having a tubular extending into a subsea unit for producing a fluid therefrom and a port at the wellsite for accessing the fluid, the method comprising:

establishing fluid communication between an interface and the port;

establishing fluid communication between a separation circuit and the interface, the separation circuit comprising at least one sample chamber and a pumping unit, the pumping unit comprising a plurality of pumping chambers, the plurality of pumping chambers each having a cylinder with a piston therein defining a fluid cavity and a buffer cavity;

selectively flowing the fluid between the separation circuit, the interface and the port at a controlled rate by selectively manipulating the buffer fluid between the buffer cavities of the plurality of pumping chambers;

discharging buffer fluid from a first buffer cavity to an outtake flowline in response to receiving fluid in a first fluid cavity while discharging buffer fluid from a second buffer cavity to the outtake flowline in response to receiving fluid in a second fluid cavity;

receiving the fluid in the fluid cavity of at least one of the plurality of pumping chambers and allowing separation of the fluid into a plurality of phases therein; and collecting at least one sample of at least one of the plurality of phases of the fluid in the at least one sample chamber.

21. The method of claim 20, wherein the buffer fluid is selectively manipulated using a pressure differential across the port.

22. The method of claim 20, wherein the buffer fluid is selectively manipulated using a pump.

23. The method of claim 20, further comprising electrically connecting the separation circuit to the interface and the port for selective activation thereof.

24. The method of claim 20, further comprising deploying at least a portion of the separation circuit with a remote operated vehicle deployed from a surface unit.

25. The method of claim 20, further comprising retrieving at least a portion of the separation circuit with a remote operated vehicle deployed from a surface unit.

26. The method of claim 20, further comprising flushing at least a portion of the fluid from the separation circuit.

27. The method of claim 20, further comprising performing at least one pressure test.

28. The method of claim 20, further comprising passing the downhole fluid through a fluid separator.

* * * * *